US008951064B2

(12) United States Patent
Keswani

(10) Patent No.: US 8,951,064 B2
(45) Date of Patent: Feb. 10, 2015

(54) TERMINAL STRUCTURES FOR WIRING DEVICES

(71) Applicant: IDEAL Industries, Inc., Sycamore, IL (US)

(72) Inventor: Sushil N. Keswani, Sycamore, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 81 days.

(21) Appl. No.: 13/740,467

(22) Filed: Jan. 14, 2013

(65) Prior Publication Data

US 2013/0130537 A1 May 23, 2013

Related U.S. Application Data

(63) Continuation-in-part of application No. 12/967,493, filed on Dec. 14, 2010, now Pat. No. 8,353,716.

(51) Int. Cl.

| | |
|---|---|
| ***H01R 13/60*** | (2006.01) |
| ***H01H 23/16*** | (2006.01) |
| ***H01R 24/78*** | (2011.01) |

(Continued)

(52) U.S. Cl.

CPC ..... *H01R 24/78* (2013.01); *H01H 23/168* (2013.01); *H01R 13/70* (2013.01); *H01H 23/20* (2013.01); *H01R 25/006* (2013.01); *H01R 2103/00* (2013.01); *H01H 23/205* (2013.01)

USPC ..... 439/535

(58) Field of Classification Search

USPC ..... 439/355, 441, 161, 171, 172, 174, 535, 439/620.21, 107

See application file for complete search history.

(56) References Cited

U.S. PATENT DOCUMENTS

| | | | |
|---|---|---|---|
| 2,705,785 | A | 4/1955 | Benander |
| 2,738,482 | A | 3/1956 | Benander |

(Continued)

FOREIGN PATENT DOCUMENTS

| | | |
|---|---|---|
| CN | 101416354 | 5/2012 |
| EP | 1560301 | 3/2005 |

(Continued)

OTHER PUBLICATIONS

International Search Report for PCT/US2011/063769 dated Apr. 2, 2012.

(Continued)

*Primary Examiner* — Neil Abrams
*Assistant Examiner* — Travis Chambers
(74) *Attorney, Agent, or Firm* — Greenberg Traurig, LLP

(57) ABSTRACT

Terminal structures for wiring devices, such as receptacle assemblies, are disclosed having first and second spring assemblies constructed of a first metal and each having at least one spring finger with the first and second spring assemblies being connected to respective first and second conductive contacts that are constructed of a second metal, wherein the terminal structures are configured for push-in termination of conductive stripped ends of respective first and second wires between the at least one spring finger of the respective first and second spring assemblies and the respective first and second conductive contacts, and wherein the first and second conductive contacts are configured to be connected to respective first and second separate conductive elements. Such a terminal structure is shown for example within a receptacle assembly in the form of a grounding duplex plug outlet or switch.

19 Claims, 14 Drawing Sheets

(51) Int. Cl.

| | |
|---|---|
| ***H01R 13/70*** | (2006.01) |
| ***H01R 25/00*** | (2006.01) |
| *H01H 23/20* | (2006.01) |
| *H01R 103/00* | (2006.01) |

(56) References Cited

U.S. PATENT DOCUMENTS

| | | | | |
|---|---|---|---|---|
| 2,955,276 | A | 10/1960 | Sheldon | |
| 2,969,518 | A | 1/1961 | Slater | |
| 3,001,168 | A | 9/1961 | Smith | |
| 3,467,941 | A | 9/1969 | Martin | |
| 3,489,985 | A | 1/1970 | Martin | |
| 3,638,171 | A | 1/1972 | Huibrechtse | |
| 3,671,925 | A | 6/1972 | Drapkin | |
| 4,172,628 | A | 10/1979 | Lingaraju | |
| 4,223,971 | A | 9/1980 | Dola et al. | |
| 4,422,701 | A | 12/1983 | Anderson | |
| 4,701,000 | A | 10/1987 | Suprono | |
| 6,010,347 | A | 1/2000 | Lee | |
| 6,563,049 | B2 * | 5/2003 | May | 174/59 |
| 7,150,646 | B2 | 12/2006 | Trumper | |
| 7,252,534 | B2 | 8/2007 | Reibke | |
| 7,354,296 | B1 | 4/2008 | Katwala et al. | |
| 7,507,106 | B2 | 3/2009 | Keswani et al. | |
| 7,762,838 | B2 * | 7/2010 | Gorman | 439/536 |
| 8,057,265 | B2 | 11/2011 | Youssefi-Shams et al. | |
| 8,267,719 | B1 * | 9/2012 | Benoit et al. | 439/535 |
| 2003/0171041 | A1 | 9/2003 | Blaha | |
| 2004/0152355 | A1 | 8/2004 | Rudy | |
| 2006/0063419 | A1 | 3/2006 | Steinkemper et al. | |
| 2009/0186517 | A1 | 7/2009 | Keswani et al. | |
| 2010/0173531 | A1 | 7/2010 | Holste | |

FOREIGN PATENT DOCUMENTS

| | | |
|---|---|---|
| EP | 1916742 | 4/2008 |
| EP | 2194617 | 6/2010 |

OTHER PUBLICATIONS

Written Opinion of the International Searching Authority for PCT/US2011/063769 dated Apr. 2, 2012.

International Preliminary Report on Patentability (Chapter II of the Patent Cooperation Treaty) for PCT/US2011/063769 dated Feb. 1, 2013.

Notification of the Second Office Action re Application No. 201180060062.6, Serial No. 2014081801003580, Date of Issuance Aug. 21, 2014, 11 pgs.

Supplementary European Search Report re Application No. EP 11 84 9648, Date of Completion Apr. 8, 2014, 6 pgs.

* cited by examiner

TERMINAL STRUCTURES FOR WIRING DEVICES

CROSS-REFERENCE TO RELATED APPLICATION

This application is a continuation-in-part application of U.S. Utility application Ser. No. 12/967,493, filed Dec. 14, 2010, the disclosure of which is hereby incorporated herein by reference.

BACKGROUND

This disclosure relates generally to novel terminal structures for wiring devices for use in electrical apparatus and in systems incorporating such electrical apparatus. A possible, but by no means exclusive, application for the use of the example terminal structures for wiring devices is within electrical receptacle assemblies having push-in wire termination. Such electrical apparatus may be configured, for instance, as a duplex plug outlet, a grounding duplex plug outlet, a light switch or light bulb socket for commercial or residential use, which will be more generally referred to simply as receptacle assemblies. A plurality of such example receptacles may be electrically connected together to form a wiring system such as for use in an enclosure, such as a room, where the receptacles may be installed in walls, floors and/or ceilings.

Historically, with respect to terminal structures for wire termination in wiring devices, in receptacles, such as duplex plug outlets, there have been many terminal structures that include a clamping fastener, such as a screw. However, these structures require bending of a conductive stripped end of a wire, so as to encircle the shaft of the screw, and additional time and labor in backing the screw outward to accommodate the wire and then tightening the screw to affect a proper connection.

Other duplex plug outlets have used push-in wire termination structures of one of three basic types. The first type includes a push-in contact that is integrally formed as spring fingers that extend from the major brass structure that also is configured to engage a plug contact. These types of structures have encountered problems due to the stress-relaxation inherent in such brass structures, which lead to failure of the wire connection. They also are less effective when used with stranded wires which may spread out width wise during insertion and over time.

The second type of push-in wire termination structure includes a push-in contact that is formed by having a spring finger held by a housing in a position opposite a major brass structure that is configured to engage a plug contact and is held in a separate position within housing. These types of structures add complexity by having to properly place and hold multiple separate components within a housing during and after completing assembly of the housing. Also an inserted wire tends to push apart the spring finger and the major brass structure in these types of terminal structures, which then must be resisted by the portions of the housing that are configured to hold the separate components. In addition, these types of structures do not offer the opportunity to provide any productive conductivity by the separately held spring finger and do not tend to have structures that will force stranded wires together to retain a consistent level of compression.

The third type of push-in wire termination structure includes a contact assembly that requires the wire to be pushed into the receptacle and then further manipulated, such as by sliding the wire into a slot that has a pair of opposed flanges that are designed to cut through the wire insulation and engage the conductor within the wire. These types of structures add complexity that is necessary to allow the user to accurately manipulate the wire after insertion, while still leaving some uncertainty as to the extent of the engagement because of the need to penetrate the wire insulation while also not cutting through the conductive end of the wire.

Thus, prior art terminal structures for wiring devices may be found in numerous forms and suffer from a variety of disadvantages that may potentially result in reduced effectiveness over time, reduced conductivity, increased complexity of assembly, and/or increased time and labor required during installation.

SUMMARY

It would be highly advantageous to have terminal structures for wiring devices, such as for use in receptacle assemblies or other electrical apparatus, that are capable of push-in wire termination for connection to other such electrical apparatus, for instance, by daisy chaining (running wires from one device to the next to connect a plurality of devices). Thus, all electrical connections within a wiring system, whether such terminal structures are incorporated into a receptacle assembly that is configured in the form of a duplex plug outlet, a grounding duplex plug outlet, a light switch, a light bulb socket or other structure, may be made by push-in termination to the devices for convenient access, installation and repairs.

An example of use of such terminal structures for wiring devices may be provided within an electrical receptacle assembly that more particularly is shown in an example grounding duplex plug outlet or within two example switches. While shown in the form of such an electrical apparatus having a two-piece housing construction for a grounding duplex plug outlet or for switches, it will be understood that alternative receptacle assembly structures, switch housings, lamp housings, or other structures and corresponding additional contacts may be utilized. Importantly, the advantageous combinations of components provide terminal structures having push-in termination for the conductive ends of stripped wires for wiring devices where the terminal structures are capable of functioning regardless of how they are held within a housing of an electrical apparatus, because a spring assembly and opposed conductive contact are fixed to each other, while the conductive contact also provides for engagement with a separate conductive element. This can provide a reduction in complexity of assembly of the components within the housing, and the conductivity of the push-in termination can benefit from the direct contact with and connection of a spring finger of the spring assembly if a conductive metal is used for the spring assembly. This also can provide a more secure and durable wire connection due to the use of a more suitable material for the spring finger, more convenient and faster field installation, and is well suited for use with solid or stranded wire. As noted above, while shown in an example of a grounding duplex plug outlet and two different switches, it will be appreciated that the terminal structures could be incorporated into other receptacle assemblies used in electrical apparatus and systems.

The example terminal structures for wiring devices disclosed herein are adapted for use within electrical apparatus, such as in the form of receptacle assemblies. The example terminal structures provide push-in wire termination, are simpler to assemble into a housing, and to install within a wiring system. The disclosed terminal structures may be configured to allow for the ability to daisy chain a plurality of some types of electrical apparatus, such as receptacles, by connecting from one receptacle assembly to one or more additional receptacle assemblies or other electrical apparatus. Thus, a building wiring system may include a plurality of receptacle assemblies having the terminal structures, such as for use in commercial or residential construction.

With respect to the electrical capacity of terminal structures for wiring devices, electrical codes normally require that daisy chaining connections must be able to handle a full branch circuit current load which, in the U.S., commonly is 20 amps. In the example that incorporate push-in wire connections in a grounding duplex plug outlet, each separate wire connection of the disclosed receptacle assembly includes at least two metal pieces that are connected together, where a first metal piece generally provides the majority of the conductivity and a second metal piece generally provides contact pressure to the wire to hold it against the first metal piece while also potentially providing some additional conductivity. However, even in the example switches, each separate wire connection of the disclosed receptacle assembly also includes at least two metal pieces that are connected together, where a first metal piece generally provides the majority of the conductivity and a second metal piece generally provides contact pressure to the wire to hold it against the first metal piece while also potentially providing some additional conductivity. When using the term "metal" with respect to the material of a component, it will be understood that the construction of such a component may include one or more metals or alloys in combination to form the component.

Accordingly, it is preferred that the terminal structures for wiring devices, such as electrical apparatus in the form of a receptacle assembly, for example as a grounding duplex plug outlet or a switch, include push-in wire termination for both inlet and outlet wire connection ports utilizing at least two pieces of metal in the terminal structures, which are configured to be connected together in a terminal structure having spring fingers opposed to conductive contacts for push-in wire termination. The example apparatus in this disclosure include a separate grounding strip for a Ground wire push-in termination that is within the receptacle housing, along side of respective Hot and Neutral (or Traveler) wire push-in terminations for connection to a power source, so that a three-wire cable or other wiring combination could be terminated directly and completely at the receptacle assembly. The grounding duplex plug outlet example terminal structures also include capacity for daisy chaining to other electrical devices by permitting insertion of additional Hot, Neutral (or Traveler) and Ground wires, which could be employed in other receptacle assemblies.

In a first aspect, the disclosure provides a terminal structure for wiring devices having a first spring assembly constructed of a first metal and having at least one spring finger, with the first spring assembly being connected to a first conductive contact that is constructed of a second metal, wherein the terminal structure is configured for push-in termination of a conductive stripped end of a first wire between the at least one spring finger of the first spring assembly and the first conductive contact, wherein the first conductive contact is configured to be connected to a first separate conductive element, and further having a second spring assembly constructed of the first metal and having at least one spring finger, with the second spring assembly being connected to a second conductive contact that is constructed of the second metal, wherein the terminal structure is configured for push-in termination of a conductive stripped end of a second wire between the at least one spring finger of the second spring assembly and the second conductive contact, and wherein the second conductive contact is configured to be connected to a second separate conductive element.

In a second aspect, the disclosure provides a receptacle assembly comprising a housing and a terminal structure, the terminal structure is disposed in the housing and includes a first spring assembly constructed of a first metal and having at least one spring finger, the first spring assembly being connected to a first conductive contact that is constructed of a second metal, wherein the terminal structure is configured for push-in termination of at least one conductive stripped end of a first wire between the at least one spring finger of the first spring assembly and the first conductive contact, and wherein the first conductive contact is configured to be connected to a first separate conductive element, and further including a second spring assembly constructed of the first metal and having at least one spring finger, the second spring assembly being connected to a second conductive contact that is constructed of the second metal, wherein the terminal structure is configured for push-in termination of at least one conductive stripped end of a second wire between the at least one spring finger of the second spring assembly and the second conductive contact, and wherein the second conductive contact is configured to be connected to a second separate conductive element.

In a third aspect, the disclosure provides a terminal structure for wiring devices for use within a housing of an electrical apparatus, the terminal structure having a first spring assembly constructed of a first metal and having at least one spring finger with the first spring assembly being fixedly connected to a first conductive contact that is constructed of a second metal, wherein the terminal structure is configured to receive a conductive stripped end of a first wire when the conductive stripped end of the first wire is inserted directly between the at least one spring finger of the first spring assembly and the first conductive contact, wherein the first conductive contact includes an extension, and further including a second spring assembly constructed of the first metal and having at least one spring finger with the second spring assembly being fixedly connected to a second conductive contact that is constructed of the second metal, wherein the terminal structure is configured to receive a conductive stripped end of a second wire when the conductive stripped end of the second wire is inserted directly between the at least one spring finger of the second spring assembly and the second conductive contact, and wherein the second conductive contact includes an extension, and further wherein the extension of the first conductive contact is configured to be electrically connected to the extension of the second conductive contact when a movable non-conductive switch member is in an On position and to be electrically disconnected from the extension of the second conductive contact when the non-conductive switch member is in an Off position.

In a fourth aspect, the disclosure provides a receptacle assembly having a housing and a terminal structure, the terminal structure disposed in the housing and including a first spring assembly constructed of a first metal and having at least one spring finger with the first spring assembly being fixedly connected to a first conductive contact that is constructed of a second metal, wherein the terminal structure is configured to receive a conductive stripped end of a first wire when the conductive stripped end of the first wire is inserted directly between the at least one spring finger of the first spring assembly and the first conductive contact, wherein the first conductive contact includes an extension, and further including a second spring assembly constructed of the first metal and having at least one spring finger with the second spring assembly being fixedly connected to a second conductive contact that is constructed of the second metal, wherein the terminal structure is configured to receive a conductive stripped end of a second wire when the conductive stripped end of the second wire is inserted directly between the at least one spring finger of the second spring assembly and the second conductive contact, and wherein the second conductive contact includes an extension, and further wherein the extension of the first conductive contact is configured to be electrically connected to the extension of the second conductive contact when a movable non-conductive switch member is in an On position and to be electrically disconnected from the extension of the second conductive contact when the non-conductive switch member is in an Off position.

Thus, it will be appreciated that the present disclosure provides examples of terminal structures for wiring devices for use in electrical apparatus, such as receptacle assemblies and systems which may utilize a plurality of such electrical apparatus. Accordingly, while the present disclosure shows and demonstrates various example components, the examples are merely illustrative and are not to be considered limiting. It will be apparent to those of ordinary skill in the art that various terminal structures for wiring devices, electrical apparatus and receptacle assemblies, incorporating such structures and systems incorporating the electrical apparatus can be constructed without departing from the scope or spirit of the present disclosure. Thus, although certain examples are described herein, the scope of coverage of this patent is not limited thereto.

It should be understood that the drawings are not necessarily to scale and that actual embodiments may differ. It also should be understood that the claims are not limited to the particular examples or combinations thereof.

DETAILED DESCRIPTION

FIGS. 1-10 illustrate an example electrical apparatus 10 that employs novel terminal structures for wiring devices. The example electrical apparatus 10 is shown in the form of a receptacle assembly and more particularly here as a grounding duplex plug outlet, for commercial or residential use as may be electrically connected together, such as by daisy chaining, to form a wiring system for an interior or exterior of an enclosure, such as a room or building. Such receptacles may be mounted as needed, for instance within walls, floors and/or ceilings to provide a suitable wiring system. It will be understood that the example receptacle 10 is an example of an electrical apparatus within which the novel terminal structures for wiring devices may be used, but is not an exclusive application or way in which such terminal structures may be employed.

Figure 1:
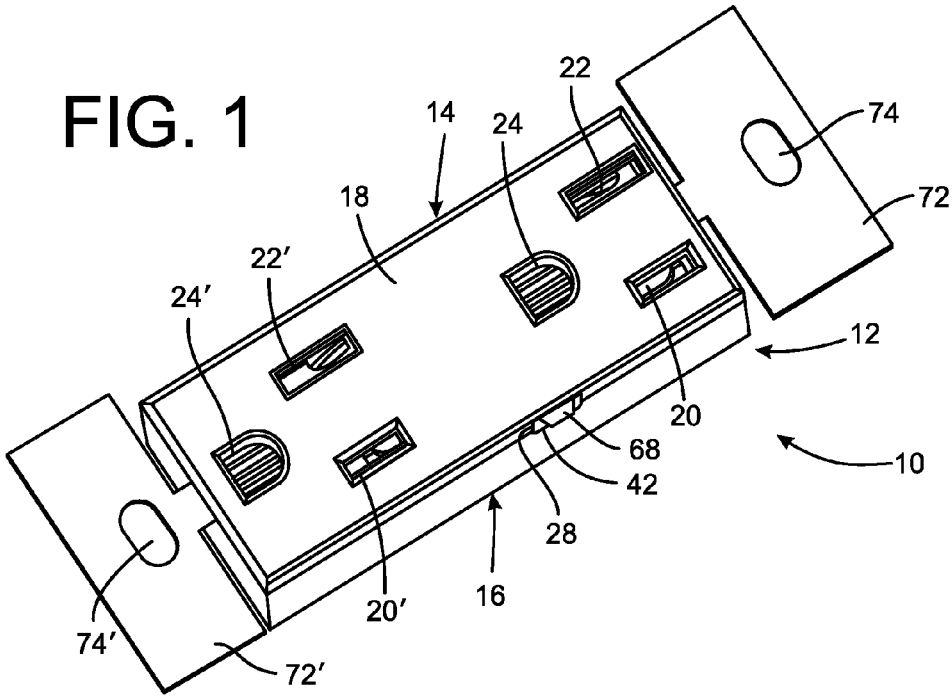
FIG. 1 is a front perspective view of an example electrical apparatus employing the novel terminal structures for wiring devices of the present disclosure.
Figure 2:
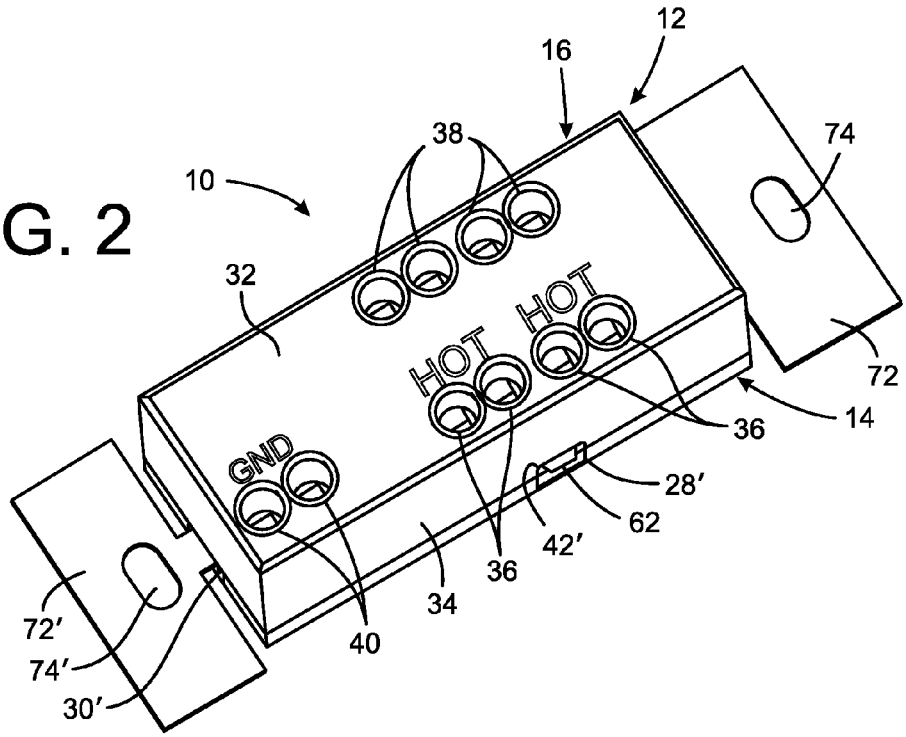
FIG. 2 is rear perspective view of the example electrical apparatus of FIG. 1.

FIGS. 1 and 2 show the exterior of the receptacle assembly 10, which includes a housing 12 having a front body 14 and a rear body 16, with both components preferably being constructed of one or more non-conductive materials, such as thermoplastic, thermoset plastic or other suitable materials. It will be understood that front and rear are used in a relative sense but the orientation of the final receptacle assembly alternatively could result in such housing portions being sides or top or bottom portion. The front body 14 includes a planar front face 18 having first separate conductive element inlet ports 20, 20' for receipt of respective first separate conductive elements of a separate electrical apparatus, such as a first blade of a plug on a grounding duplex electrical cord. The front body 14 includes second separate conductive element inlet ports 22, 22' for receipt of respective second separate conductive elements of such a separate electrical apparatus, for instance in the form of a second blade of a plug on a grounding duplex electrical cord. The front body 14 further includes third separate conductive element inlet ports 24, 24' for receipt of respective third separate conductive elements of such a separate electrical apparatus, for instance in the form of a ground pin of a plug on a grounding duplex electrical cord.

As best seen in FIGS. 1-4, 9 and 10, the front body 14 also includes an upstanding side wall 26 around the perimeter and projecting from a rear face 18'. The side wall 26 includes notches 28, 28' along elongated sides, and notches 30, 30' along the ends, as will be discussed in further detail herein. Locating walls 31, 31', 31" extend from the rear face 18' and include channels 33, 33', 33", as will be discussed further herein.

Figure 3:
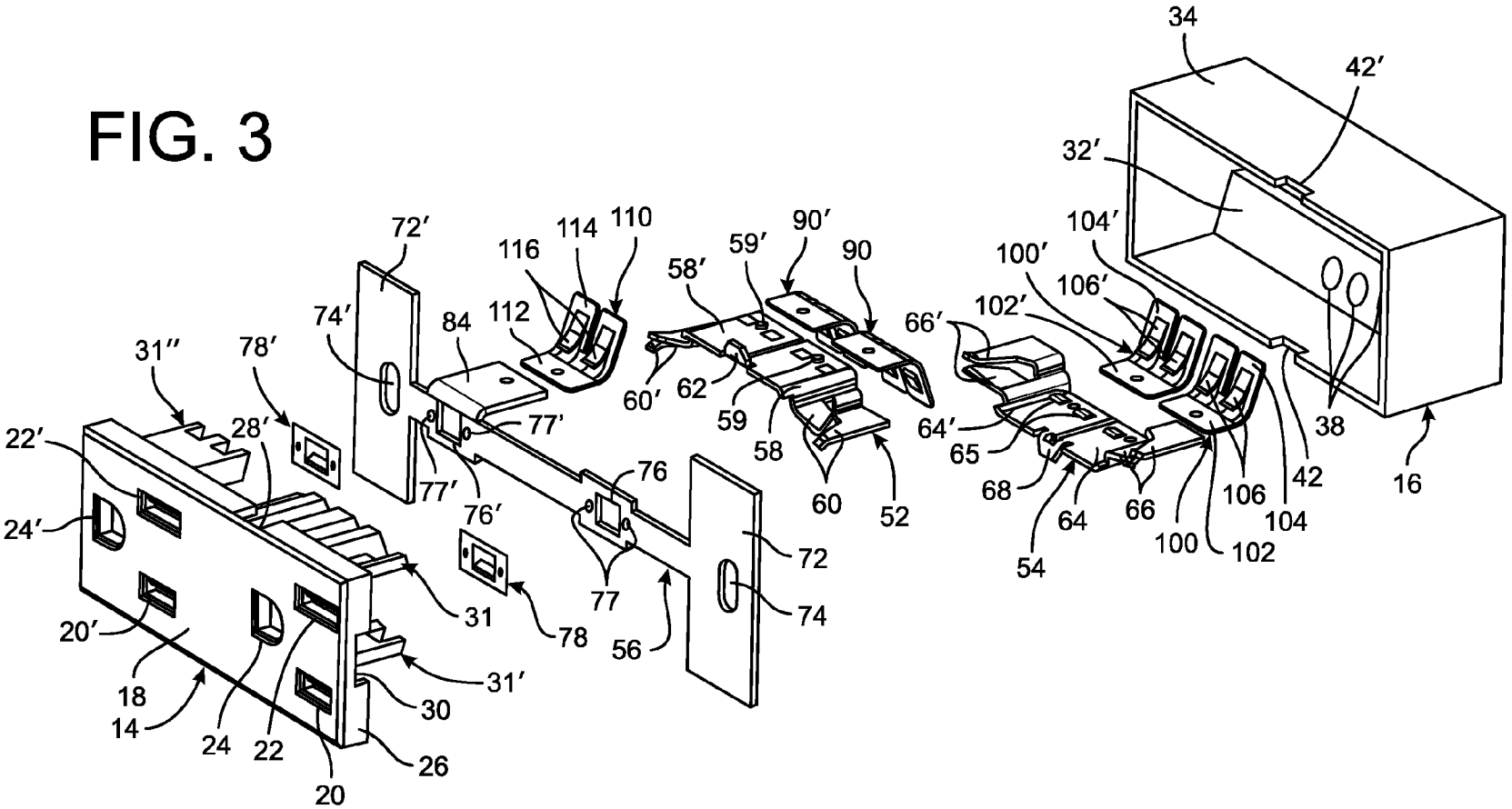
FIG. 3 is a front perspective exploded view of the example electrical apparatus of FIG. 1.
Figure 4:
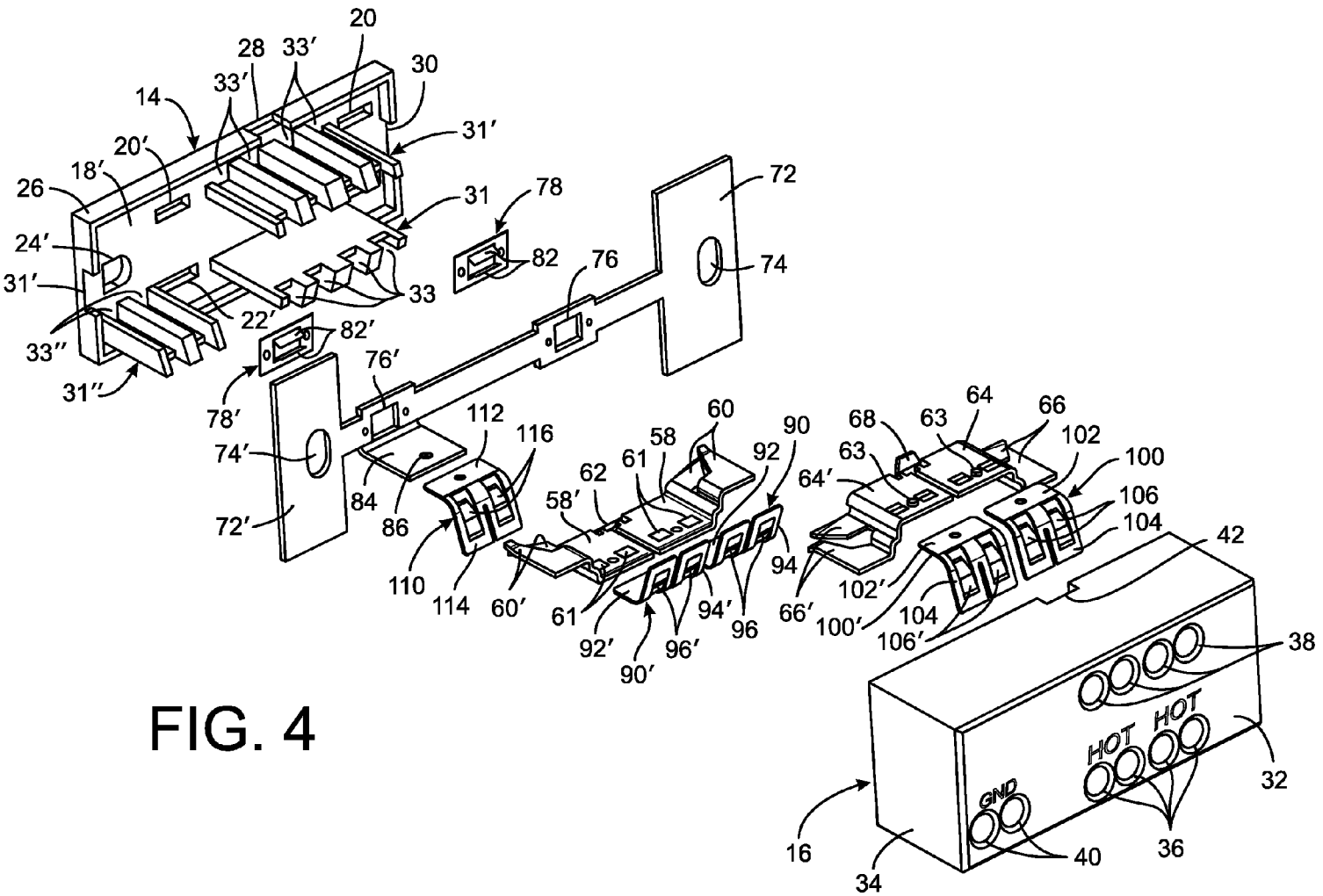
FIG. 4 is a rear perspective exploded view of the example electrical apparatus of FIG. 1.
Figure 5:
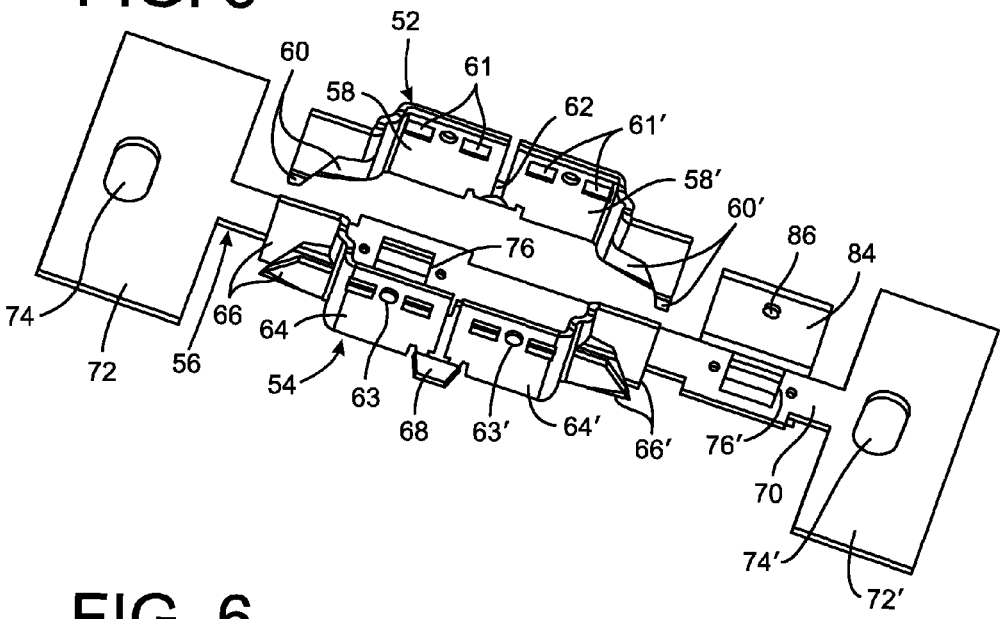
FIG. 5 is rear perspective view of the first, second and third conductive contacts of the example electrical apparatus of FIG. 1.
Figure 6:
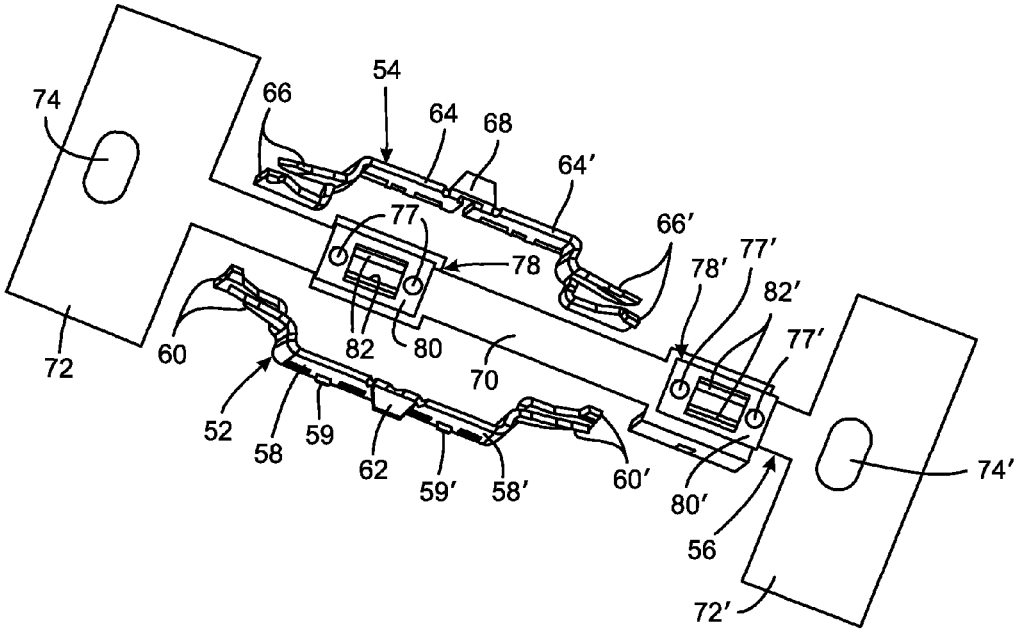
FIG. 6 is a front perspective view of the conductive contacts of FIG. 5.
Figure 7:
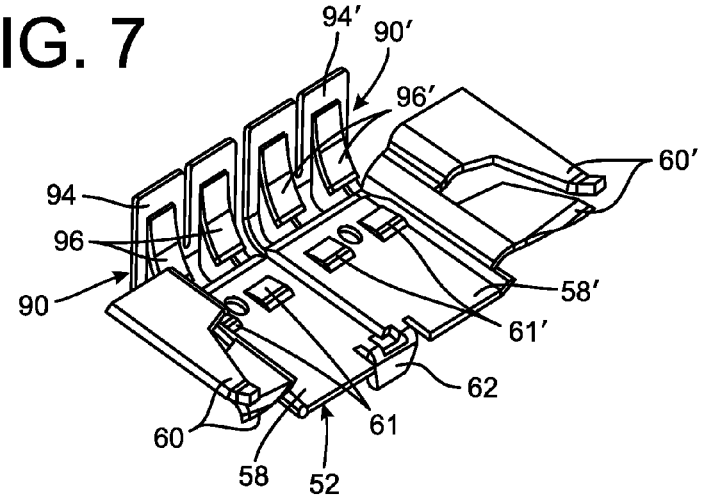
FIG. 7 is a perspective view of the first conductive contact of FIG. 5 with two spring assemblies connected thereto.

As best seen in FIGS. 2-4, the rear body 16 of the housing 12 includes a front face 32 and an upstanding side wall 34 around the perimeter and projecting from a rear face 32'. The front face 32 of the rear body 16 includes a plurality of first wire entry ports 36 and a plurality of second wire entry ports 38, with this example being illustrated as having four of each. The front face 32 of the rear body 16 also includes a plurality of third wire entry ports 40, with this example being illustrated as having two such ports. The side wall 34 includes notches 42, 42' along elongated sides, which are aligned with the notches 28, 28' when the front body 14 and rear body 16 are connected, such as by use of welding, adhesives, fasteners or other suitable means of connection.

Figure 8:
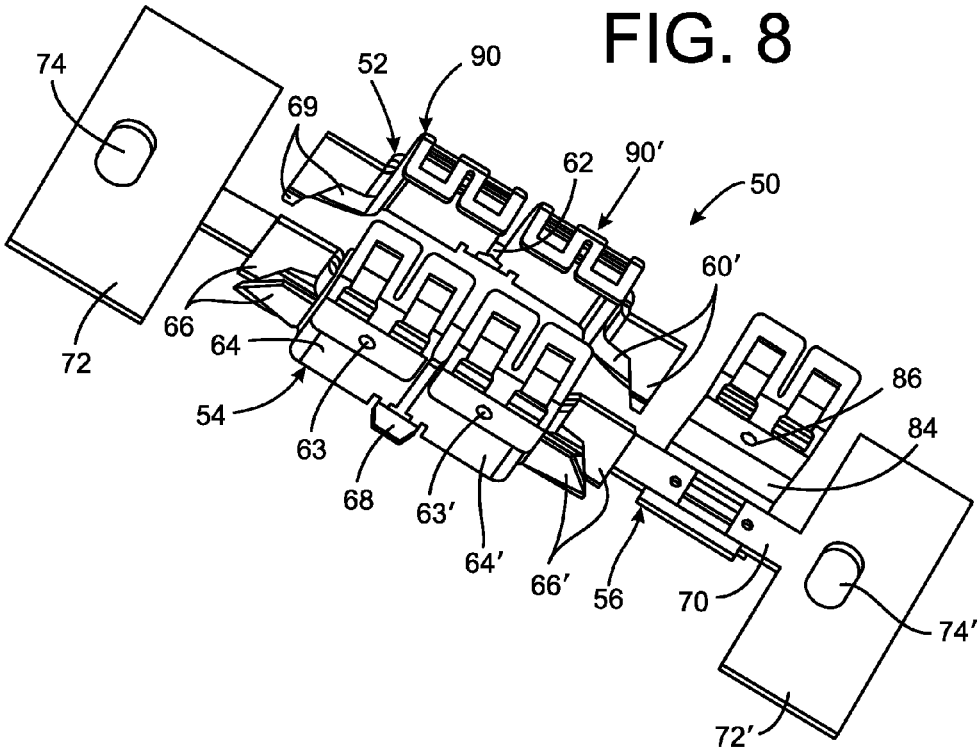
FIG. 8 is a rear perspective view similar to FIG. 5 but with respective spring assemblies connected to the conductive contacts.
Figure 9:
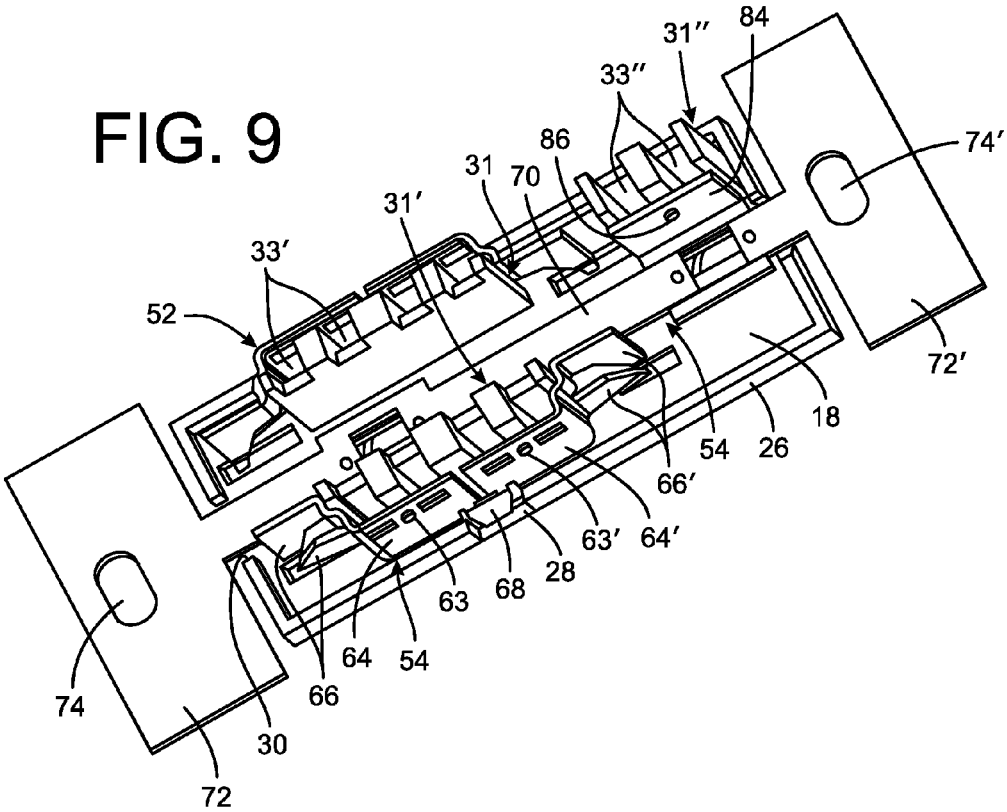
FIG. 9 is rear perspective view similar to FIG. 5 but with the respective conductive contacts located relative to a front face plate of the example electrical apparatus of FIG. 1.
Figure 10:
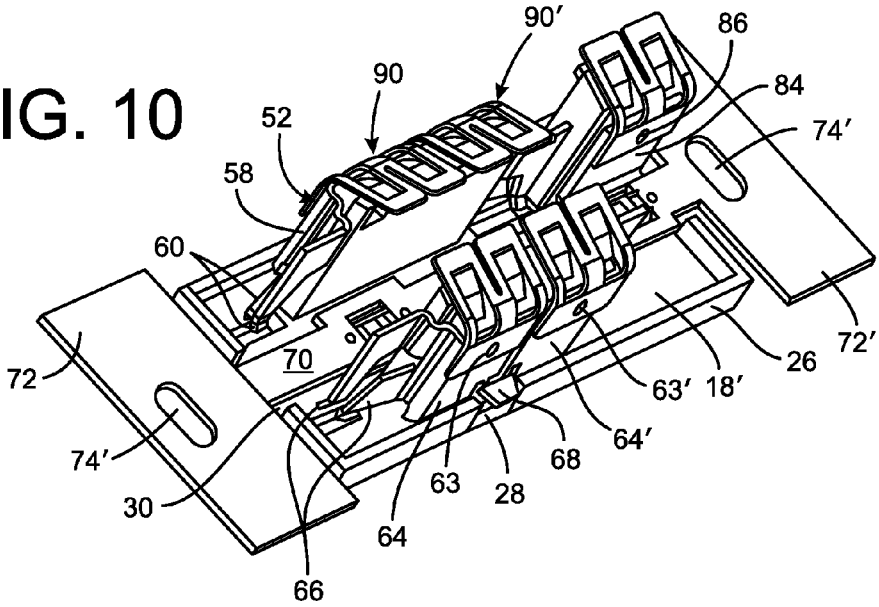
FIG. 10 is a rear perspective view similar to FIG. 9 but with the spring assemblies shown in FIG. 8 fixed to the respective conductive contacts.

In the present illustrated example, the electrical apparatus in the form of the receptacle assembly 10 includes a terminal structure 50 for wiring devices, best seen in FIG. 8. The terminal structure 50 of this example includes a first conductive contact 52, a second conductive contact 54 and a third conductive contact 56. The first and second conductive contacts 52, 54 are constructed of one or more highly conductive materials, such as brass or another copper alloy, or other suitable conductive materials. The third conductive contact 56 is optional and may be constructed of the same material as the first and second conductive contacts of a more rigid yet still conductive material, such as galvanized steel, or one or more other suitable conductive materials.

The first conductive contact 52 is configured to be connected to a respective first separate conductive element upon insertion of such element through a first separate conductive element inlet port 20, 20'. The inlet port 20 directs an inserted first separate conductive element, such as a first blade of a duplex plug, into engagement with the first conductive contact 52, where it engages a body portion 58 via insertion between a pair of integrally formed spring fingers 60 that extend from the body portion 58. The spring fingers 60 have ramped leading edges to facilitate insertion of a first separate conductive element therebetween. In this example, the body portion 58 also includes a post 59 on one side and optional protrusions 61 on the opposite side. These features will be discussed in further detail herein.

The opposite end of the first conductive contact 52 includes a similarly configured body portion 58' and integrally formed spring fingers 60' that need not be but in this example are a mirror image of body portion 58 and spring fingers 60, and the spring fingers 60' are similarly adapted to receive a respective first separate conductive element therebetween when such element is inserted through the inlet port 20'. The body portion 58' includes a post 59' on one side and optional protrusions 61' on the opposite side. The body portions 58 and 58' are connected by a removable integrally formed tab 62, which extends from the housing 12 through the notch 28' of the front body 14 and the notch 42' of the rear body 16 of the housing 12. If desired, the tab 62 may be removed by conventional means to cause the receptacle 10 to have two separate circuits.

Similarly, the second conductive contact 54 of the terminal structure 50 is configured to be connected to a respective second separate conductive element upon insertion of such an element through a second separate conductive element inlet port 22, 22'. The inlet port 22 directs an inserted second separate conductive element, such as a second blade of a duplex plug, into engagement with the second conductive contact 54, where it engages a body portion 64 via insertion between integrally formed spring fingers 66. The spring fingers 66 have ramped leading edges to facilitate insertion of a first separate conductive element therebetween. In this example, the body portion 64 also includes a post 63 on one side and optional protrusions 65 on the opposite side. These features will be discussed in further detail herein.

The opposite end of the second conductive contact 54 includes a similarly configured body portion 64' and integrally formed spring fingers 66' that also need not be but in this example are a mirror image of body portion 64 and spring fingers 66 and are similarly adapted to receive a second separate conductive element therebetween. The body portion 64' includes a post 63' on one side and protrusions 65' on the opposite side. The body portions 64 and 64' are connected by a removable integrally formed tab 68, which extends from the housing 12 through the notch 28 of the front body 14 and the notch 42 of the rear body 16 of the housing 12. If desired, the tab 68 similarly may be removed to cause the receptacle 10 to have two separate circuits. Preferably, if the receptacle is to be configured to have separate circuits, then both tabs 62 and 68 should be removed.

The example terminal assembly 50 is shown with the third conductive contact 56 configured to be connected to a respective third separate conductive element upon insertion of such element through a third separate conductive element inlet port 24, 24'. In this example, using a duplex plug receptacle 10, the third conductive contact 56 is adapted to serve as a Ground strap. As such, the third conductive contact 56 has a central elongated portion 70 that runs through the housing 12 along the rear face 18' of the front body 14 and projects outward from the ends of the housing 12 through notches 30, 30' in the front body 14. After passing through the notches 30, 30' at each end, the ends of the third conductive contact 56 broaden into respective mounting flanges 72, 72', such as for mounting the receptacle 10 to a receptacle box that may be mounted within a wall structure via fasteners (not shown) passing through apertures 74, 74' in the mounting flanges 72, 72', respectively.

The central portion 70 includes a pair of apertures 76, 76' that are adapted to receive a third separate conductive element, such as a Ground pin of a grounding duplex plug that would be inserted through and guided by a third separate conductive element inlet port 24, 24'. The central portion 70 also includes pairs of small posts 77, 77' near the apertures 76, 76'. To enhance repeatable engagement with a third separate conductive element, each aperture 76, 76' receives a spring contact 78, 78'. Each spring contact 78, 78' has a base 80, 80' with a pair of apertures that receive the posts 77, 77', which then are deformed to achieve connection of the spring contacts 78, 78' to the central portion 70. A pair of spring fingers 82, 82' extend from the base 80, 80' and are disposed within the apertures 76, 76' of the central portion 70 for engagement with a respective third separate conductive element, such as a Ground pin of a plug. The central portion 70 of the third conductive contact 56 also includes a mounting flange 84 extending therefrom, and having a post 86, which will be discussed further herein.

The example terminal structure 50 in the electrical apparatus 10 includes spring assemblies to facilitate push-in termination of conductive stripped ends of respective wires. The spring assemblies preferably may be constructed of one or more materials that are more suitable for use as a spring, such as stainless steel, phosphor bronze, steel or other suitable materials to resist stress-relaxation and yielding over time, while still having some conductivity. Each spring assembly includes at least one spring finger coupled to a foot portion. For instance, a pair of first spring assemblies 90, 90' each include a foot portion 92, 92', an upstanding leg 94, 94' and at least one spring finger 96, 96' extending from the upstanding leg 94, 94'. It will be understood that the term "foot portion" is not used herein to denote a relative position, such as being above or below or in any other direction relative to another structure, and in that sense could also be considered simply to denote a base. It also will be understood that the at least one spring finger is coupled to the foot portion in this example via an upstanding leg, but the term "upstanding leg" is not used herein to denote a relative position or direction, but rather could refer to a structure that extends upward, downward or in any other direction relative to the foot portion.

In this example, each spring assembly 90, 90' includes two spring fingers 96, 96' extending from the upstanding leg 94, 94'. Each first spring assembly 90, 90' is fixed to a body portion 58, 58' of the first conductive contact 52. To achieve this, each foot portion 92, 92' includes an aperture that receives a post 59, 59' on a body portion 58, 58', and each post 59, 59' then is deformed to connect the first spring assembly 90, 90' to the first conductive contact 52. It will be appreciated that other means of connecting a spring assembly to a conductive contact may be used, such as by welding, use of a separate fastener or other suitable connection means.

A conductive stripped end of a first wire, such as a Hot wire, may be inserted through one of the first wire entry ports 36 which will guide the wire end into engagement with at least one of the spring fingers 96, 96'. As the wire end is further advanced, the spring finger 96, 96' that is coupled to a foot portion 92, 92' and thereby fixed to a first contact 52 will bend and permit the wire end to pass through the spring assembly 90, 90' where the wire end will engage the first conductive contact 52. While an adequate electrical connection may be achieved when a stripped wire end engages a flat conductive contact, in this example, as the wire end engages the first conductive contact 52 it will ride up and over an optional projection 61, 61' which will assist in establishing a firm connection between the conductive stripped end of the first wire and the first conductive contact 52, whether solid or stranded wire, also increasing the resistance to wire pull-out.

The high level of conductivity of the first conductive contact 52 promotes a good electrical connection, and this is further aided by the spring assembly 90, 90' having some conductivity and being connected to the first conductive contact 52. In addition, the first spring assembly 90, 90' being constructed of a material more fitting for usage as a spring provides enhanced clamping performance initially and is less likely to relax or yield over repeated use or time. The wire end need not be bent by a user during installation so as to encircle a screw, and as the straight wire end is advanced it will come to rest in one of the channels 33 between the locating wall 31 of the front body 14 and the first conductive contact 52, where it will be contained and shielded from inadvertent contact with other components. It will be appreciated that such channels provide an example of promoting an advantageous but not necessarily required means of achieving and maintaining wire separation. Such channels also may assist in keeping stranded wires from splaying, thus promoting more consistent conductive contact engagement.

The fixed connection between the first conductive contact 52 and the first spring assemblies 90, 90' permits more simple housing configurations and the electrical components to be more easily placed and located within the receptacle assembly 10 because such components need not be separately held by the housing in positions that must resist a separation force that is introduced when a wire end is inserted. Instead, the separation or displacement forces imposed when a wire end is inserted are controlled within the terminal structure 50 itself, without exerting forces on the housing 12.

The example terminal structure 50 similarly includes a pair of second spring assemblies 100, 100' that are constructed similarly to spring assemblies 90, 90'. Thus, each second spring assembly 100, 100' includes a foot portion 102, 102', an upstanding leg 104, 104' and at least one spring finger 106, 106' extending from the upstanding leg 104, 104', with this example including two spring fingers 106, 106'. Thus, each spring finger 106, 106' is coupled to a foot portion 102, 102'. Each second spring assembly 100, 100' is connected to a body portion 64, 64' of the second conductive contact 54, as the foot portions 102, 102' include an aperture that receives a post 63, 63' on the body portion 64, 64', and the post 63, 63' then is deformed to connect the second spring assembly 100, 100' to the second conductive contact 54.

A conductive stripped end of a second wire, such as a Neutral wire, may be inserted through one of the second wire entry ports 38 which will guide the wire end into engagement with at least one spring finger 106, 106'. As the wire end is further advanced, the spring finger 106, 106' will bend and permit the wire end to pass through the second spring assembly 100, 100' where the wire end will engage the second conductive contact 54. As the wire end engages the second conductive contact 54 it will ride up and over an optional projection 65, 65' which will assist in establishing a firm connection between the conductive stripped end of the second wire and the second conductive contact 54, whether solid or stranded wire, also increasing the resistance to wire pull-out. The high level of conductivity of the second conductive contact 54 promotes a good electrical connection, and this is further aided by the second spring assemblies 100, 100' having some conductivity and being fixed to the second conductive contact 54.

In addition, the second spring assemblies 100, 100' are of similar construction to spring assemblies 90, 90', and therefore, will provide enhanced clamping performance initially and will resist relaxation and yielding over repeated use or time. Once again, the installer need not go through an extra time consuming and tedious step of bending the wire end of a second wire prior to insertion. As the second wire end is advanced, it will come to rest in one of the channels 33' between the locating wall 31' of the front body 14 and the second conductive contact 54, where, in this example, it will be subjected to the same advantages as noted above with respect to receipt of the first wire end in a channel. Also, as with the previously described first spring assemblies 90, 90' and first conductive contact 52, the separation or displacement forces imposed when a wire end is inserted between a second spring assembly 100, 100' and the second conductive contact 54 are controlled within the terminal structure 50 itself, without exerting forces on the housing 12.

While the spring assemblies 90, 90' and 100, 100' each are provided with a pair of spring fingers 96, 96' and 106, 106' respectively, so as to permit the receptacle to be split into two circuits while still permitting daisy chaining to other electrical apparatus or wiring system components, the terminal structure 50 includes only one third spring assembly 110 for connection to the third conductive contact 56. In this example, the third spring assembly 110 is constructed similarly to each of spring assemblies 90, 90', 100, 100'. Thus, third spring assembly 110 includes a foot portion 112, an upstanding leg 114, and at least one spring finger 116 extending from the upstanding leg 114. In this example, the third spring assembly 110 has two spring fingers 116 that are thereby coupled to the foot portion 112. The third spring assembly 110 is fixed to the mounting flange 84 of the third conductive contact 56, as the foot portion 112 includes an aperture that receives the post 86 on the mounting flange 84, and the post 86 then is deformed to connect the spring assembly 110 to the third conductive contact 56. Once again, such fixing of a spring assembly to a conductive contact may be by other suitable connection means.

A conductive stripped end of a third wire, such as a Ground wire, may be inserted through one of the third wire entry ports 40 which will guide the wire end into engagement with at least one spring finger 116. As the wire end is further advanced the spring finger 116 will bend and permit the wire end to pass through the third spring assembly 110 where the wire end will engage the third conductive contact 56. As the wire end engages the third conductive contact 56 it will extend over the mounting flange 84 and establish a firm connection between the conductive stripped end of the third wire, whether solid or stranded wire, and will then be resistant to pull-out. The relatively higher level of conductivity of the third conductive contact 56 promotes a good electrical connection, and this is further aided by the third spring assembly 110 having some conductivity and being fixed to the third conductive contact 56.

In addition, the third spring assembly 110 is of similar construction to spring assemblies 90, 90', 100, 100' and therefore, will provide enhanced clamping performance initially and will resist relaxation and yielding over repeated use or time. As noted above with respect to the stripped ends of the first and second wires, the installer need not bend the wire end of a third wire prior to insertion. Similarly to the previously mentioned wires and structures of this example, as the wire end is advanced it will come to rest in one of the channels 33" between the locating wall 31" of the front face plate 14 and the third conductive contact 56, where, in this example, it will be subjected to the same advantages as noted above with respect to receipt of the first wire end in a channel. Also, as with the previously described first and second spring assemblies 90, 90', 100, 100' and first and second conductive contacts 52, 54, the separation or displacement forces imposed when a wire end is inserted between a third spring assembly 110 and the third conductive contact 56 are controlled within the combined terminal structure 50 itself, without exerting forces on the housing 12.

FIGS. 11-19 illustrate a further example electrical apparatus that employs novel terminal structures for wiring devices. The example electrical apparatus is shown in the form of a receptacle assembly 110 and more particularly here as a first switch, for commercial or residential use as may be electrically connected together with other components to form a wiring system for an interior or exterior of an enclosure, such as a room or building. Such receptacle assemblies may be mounted as needed, for instance within walls, floors and/or ceilings to provide a suitable wiring system. It will be understood that the example receptacle assembly 110 is an example of an electrical apparatus that is embodied in a 4-way switch, within which the novel terminal structures for wiring devices may be used, but is not an exclusive application or way in which such terminal structures may be employed.

Figure 11:
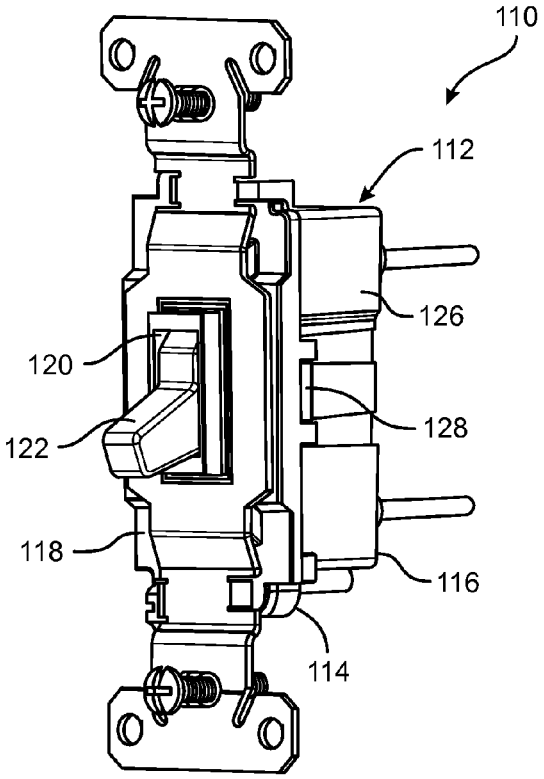
FIG. 11 is a front perspective view of another example electrical apparatus employing the novel terminal structures for wiring devices of the present disclosure, in a first switch.
Figure 12:
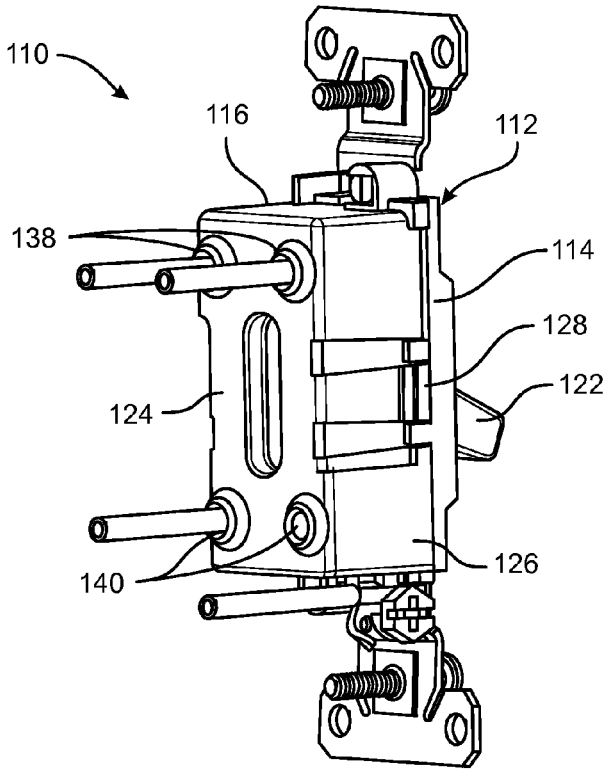
FIG. 12 is rear perspective view of the example electrical apparatus of FIG. 11.
Figure 13:
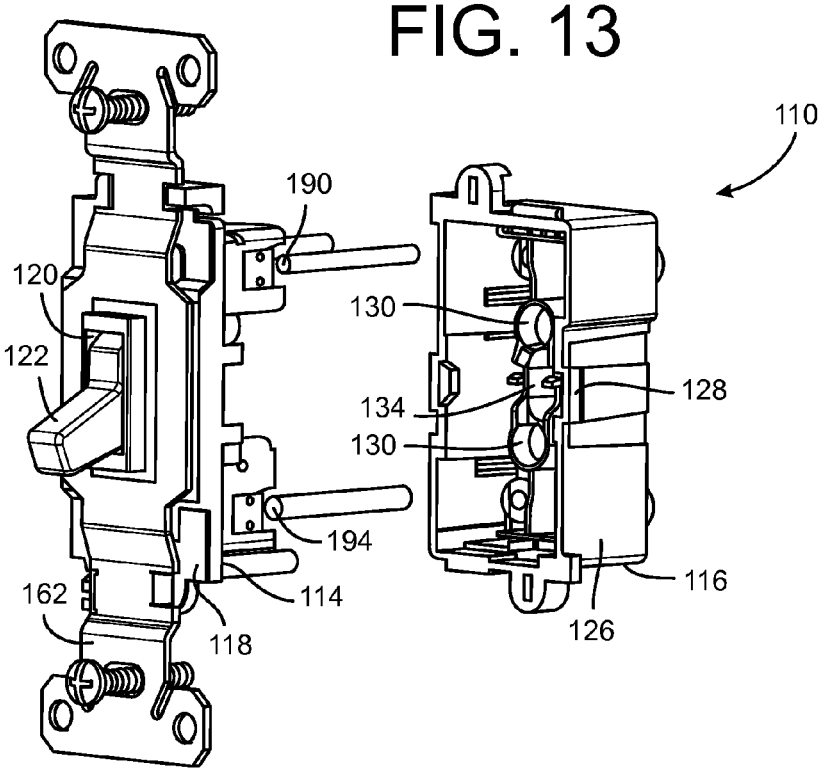
FIG. 13 is a front perspective partially exploded view of the example electrical apparatus of FIG. 11, having the rear body of the housing removed.

FIGS. 11 and 12 show the exterior of the receptacle assembly 110, which includes a housing 112 having a front body 114 and a rear body 116, with both components preferably being constructed of one or more non-conductive materials, such as thermoplastic, thermoset plastic or other suitable materials. It will be understood that front and rear are used in a relative sense but the orientation of the final receptacle assembly alternatively could result in such housing portions being sides or top or bottom portions. The front body 114 includes a front face 118 having an opening therein 120 through which extends a non-conductive switch member 122 which may be manually operated to be moved between at least two operative positions, such as an Off position and an On position. The Off and On positions are respectively associated with disconnected and connected conditions as will be discussed further herein.

Turning to FIGS. 11-14, the rear body 116 includes a rear face 124 and an upstanding side wall 126 around the perimeter and projecting from the rear face 124. The side wall 126 includes latching members 128 along its elongated sides for engagement with the front body 114. The interior surface of the rear face 124 includes receptacles 130 that receive elastomeric bodies 132, which may be made of non-conductive material, such as rubber or other suitable materials, and a further notch 134 that receives a biasing member 136, such as in the form of a coiled compression spring or other suitable structure. The biasing member 136 generally biases the non-conductive switch member 122 toward the front body.

Figure 14:
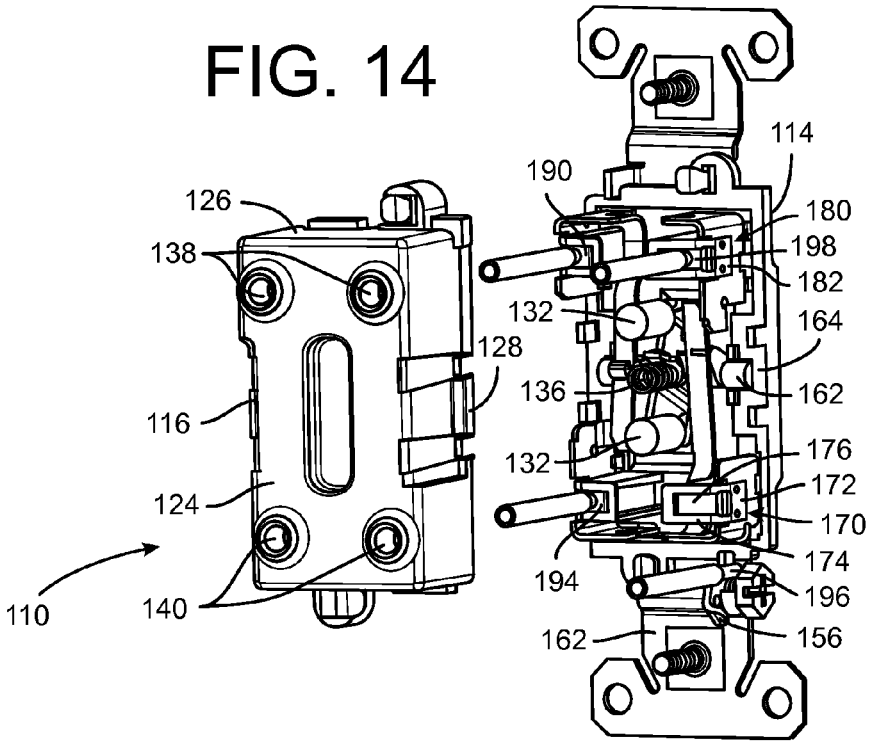
FIG. 14 is a rear perspective partially exploded view of the example electrical apparatus of FIG. 11, having the rear body of the housing removed.

As may be seen in FIGS. 12 and 14, the rear face 124 of the rear body 116 of the housing 112 includes a plurality of first wire entry ports 138 and a plurality of second wire entry ports 140, with this example being illustrated as having two of each. Each of the wire entry ports 138 may, for instance, receive a Hot wire, while each of the wire entry ports 140 may, for instance, receive a Traveler wire. The front body 114 and rear body 116 of the housing 112 may be connected, such as by use of the latching members 128, or by welding, adhesives, fasteners or other suitable means of connection.

In the present illustrated example, the electrical apparatus in the form of the receptacle assembly 110 includes a terminal structure 150 for wiring devices, best seen in FIGS. 14-17. The terminal structure 150 of this example includes a pair of first conductive contacts 152, a pair of second conductive contacts 154 and a ground terminal 156. The first and second pairs of conductive contacts 152, 154 each include a body portion 158, 160, respectively, and are constructed of one or more highly conductive materials, such as brass or another copper alloy, or other suitable conductive materials. The ground terminal 156 is connected to a ground strap 162 and may be constructed of the same material as the first and second conductive contacts, but more likely will be constructed of a more rigid yet still conductive material, such as galvanized steel, or one or more other suitable conductive materials. The ground strap 162 includes an opening through which a projection from the front body 114 extends, along with the non-conductive switch member 122.

Each of the first pair of conductive contacts 152 is configured to include an extension 152' from the body portion 158, with the extension 152' being configured to be electrically connected to a respective extension 154' that extends from the respective body portion 160 of each of the second conductive contacts 154. Engagement between the respective extensions 152' and 154' is controlled by movement of the non-conductive switch member 122 which includes projections 164 that correspond to and cause movement of the respective extensions 152', while pivots 166 pivotally engage receptacles 166 in the rear of the front body 114. Depending on the position of the non-conductive switch member 122, when moved to the Off position, a projection 164 causes deflection and spaces an extension 152' from the opposed corresponding extension 154', thereby disconnecting the respective conductive contacts 152 and 154. When the non-conductive switch member 122 is moved to the On position, the projection 164 is moved to a position where it permits the extension 152' on the first conductive contact 152 to move toward, engage and become electrically connected to the extension 154' on the second conductive contact 154.

The example terminal structure 150 in the electrical apparatus 110 includes spring assemblies to facilitate push-in termination of conductive stripped ends of respective wires. The spring assemblies preferably may be constructed of one or more materials that are more suitable for use as a spring, such as stainless steel, phosphor bronze, steel or other suitable materials to resist stress-relaxation and yielding over time, while still having some conductivity. Each spring assembly includes at least one spring finger coupled to a foot portion. For instance, a pair of first spring assemblies 170 each includes a foot portion 172, an upstanding leg 174 and at least one spring finger 176 extending from the upstanding leg 174. It will be understood that the term "foot portion" is not used herein to denote a relative position, such as being above or below or in any other direction relative to another structure, and in that sense could also be considered simply to denote a base. It also will be understood that the at least one spring finger is coupled to the foot portion in this example via an upstanding leg 174, but the term "upstanding leg" is not used herein to denote a relative position or direction, but rather could refer to a structure that extends upward, downward or in any other direction relative to the foot portion.

In this example, each spring assembly 170 is fixed to a body portion 158 of a respective first conductive contact 152. To achieve this, each foot portion 172 includes at least one aperture 177 that receives a post 178 that extends from the body portion 158, and each post 178 then is deformed to connect the first spring assembly 170 to the first conductive contact 152. It will be appreciated that other means of connecting a spring assembly to a conductive contact may be used, such as by welding, use of a separate fastener or other suitable connection means. Each body portion 158 has a surface opposite a spring finger 176 that includes an optional projection 179 configured to contact a respective conductive stripped end of a wire.

Similarly, a pair of second spring assemblies 180 each includes a foot portion 182, an upstanding leg 184 and at least one spring finger 186 extending from the upstanding leg 184. Again, the term "foot portion" is not used herein to denote a relative position, and the at least one spring finger is coupled to the foot portion via an upstanding leg 184, with the term "upstanding leg" also not used herein to denote a relative position or direction.

Each second spring assembly 180 is fixed to a body portion 160 of a respective second conductive contact 154. To achieve this, each foot portion 182 includes at least one aperture 187 that receives a post 188 that extends from the body portion 160, and each post 188 then is deformed to connect the first spring assembly 180 to the second conductive contact 154. As discussed above, it will be appreciated that other means of connecting a spring assembly to a conductive contact may be used. Each body portion 160 has a surface opposite the spring finger 186 that in this example includes an optional projection 189 configured to contact a respective conductive stripped end of a wire.

The wire entry ports 138 in the rear face 124 of the rear body 116 are configured to receive and direct respective inserted wires. A conductive stripped end 190 of a first wire, such as a Hot wire, may be inserted through one of the first wire entry ports 138 which will guide the conductive stripped end 190 of the first wire into engagement with at least one of the spring fingers 176. As the wire end 190 is further advanced, the spring finger 176 that is coupled to a foot portion 174 and thereby fixed to a first contact 152 will bend and permit the wire end to pass through the spring assembly 170 where the wire end will engage the first conductive contact 152. While an adequate electrical connection may be achieved when a stripped wire end engages a flat conductive contact, in this example, as the wire end engages the first conductive contact 152 it will ride up and over the optional projection 179 which will assist in establishing a firm connection between the conductive stripped end 190 of the first wire and the first conductive contact 152, whether solid or stranded wire, also increasing the resistance to wire pull-out.

The high level of conductivity of the first conductive contact 152 promotes a good electrical connection, and this is further aided by the spring assembly 170 having some conductivity and being connected to the first conductive contact 152. In addition, the first spring assembly 170, being constructed of a material more fitting for usage as a spring, provides enhanced clamping performance initially and is less likely to relax or yield over repeated use or time. The conductive stripped end of the wire need not be bent by a user during installation so as to encircle a screw, and as the straight wire end is advanced it will come to rest in one of the channels 192 that project from the rear of the front body 114, where the stripped end of the wire will be contained and shielded from inadvertent contact with other components. It will be appreciated that such channels provide an example of promoting an advantageous but not necessarily required means of achieving and maintaining wire separation. Such channels also may assist in keeping stranded wires from splaying, thus promoting more consistent conductive contact engagement.

In a similar manner, the wire entry ports 140 in the rear face 124 of the rear body 116 are configured to receive and direct respective inserted wires. A conductive stripped end 194 of a second wire, such as a Traveler wire, may be inserted through one of the first wire entry ports 140 which will guide the conductive stripped end 194 into engagement with at least one of the spring fingers 186. As the conductive stripped end 194 of the second wire is further advanced, the spring finger 186 that is coupled to a foot portion 184 and thereby fixed to a second contact 154 will bend and permit the wire end to pass through the spring assembly 180 where the wire end will engage the second conductive contact 154. While an adequate electrical connection may be achieved when a stripped wire end engages a flat conductive contact, in this example, as the wire end engages the second conductive contact 154 it will ride up and over the optional projection 189 which will assist in establishing a firm connection between the conductive stripped end 194 of the second wire and the second conductive contact 154, whether solid or stranded wire, also increasing the resistance to wire pull-out.

The high level of conductivity of the second conductive contact 154 promotes a good electrical connection, and this is further aided by the spring assembly 180 having some conductivity and being connected to the second conductive contact 154. In addition, the second spring assembly 180, being constructed of a material more fitting for usage as a spring, provides enhanced clamping performance initially and is less likely to relax or yield over repeated use or time. As with the conductive stripped end of the first wire, the conductive stripped end of the second wire need not be bent by a user during installation so as to encircle a screw, and as the straight wire end is advanced it will come to rest in one of the channels 192 that project from the rear of the front body 114, where the conductive stripped end of the wire will be contained and shielded from inadvertent contact with other components. It will be appreciated that such channels provide an example of promoting an advantageous but not necessarily required means of achieving and maintaining wire separation. Such channels also may assist in keeping stranded wires from splaying, thus promoting more consistent conductive contact engagement.

Figure 15:
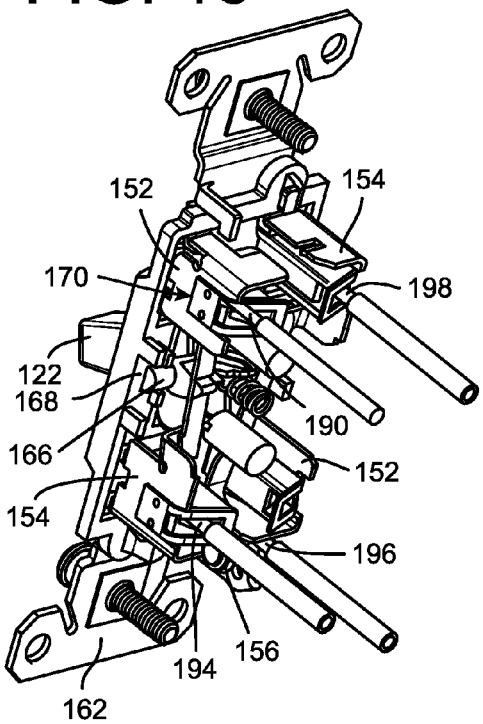
FIG. 15 is rear perspective view of the example electrical apparatus of FIG. 11, having wires inserted and without the rear body of the housing.
Figure 16:
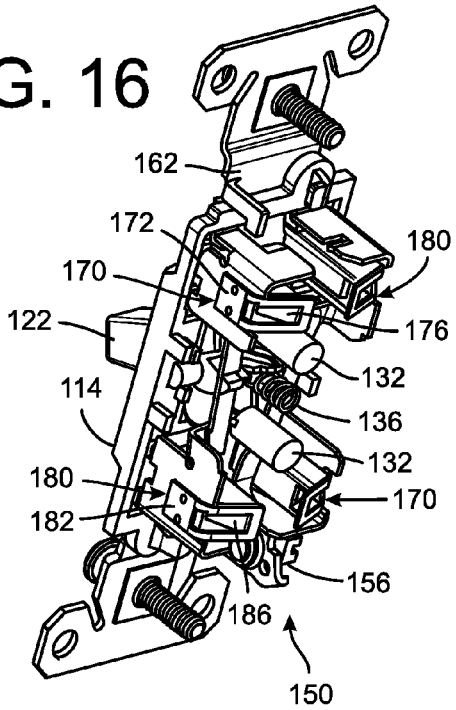
FIG. 16 is a rear perspective view of the example electrical apparatus of FIG. 15 but without wires.
Figure 17:
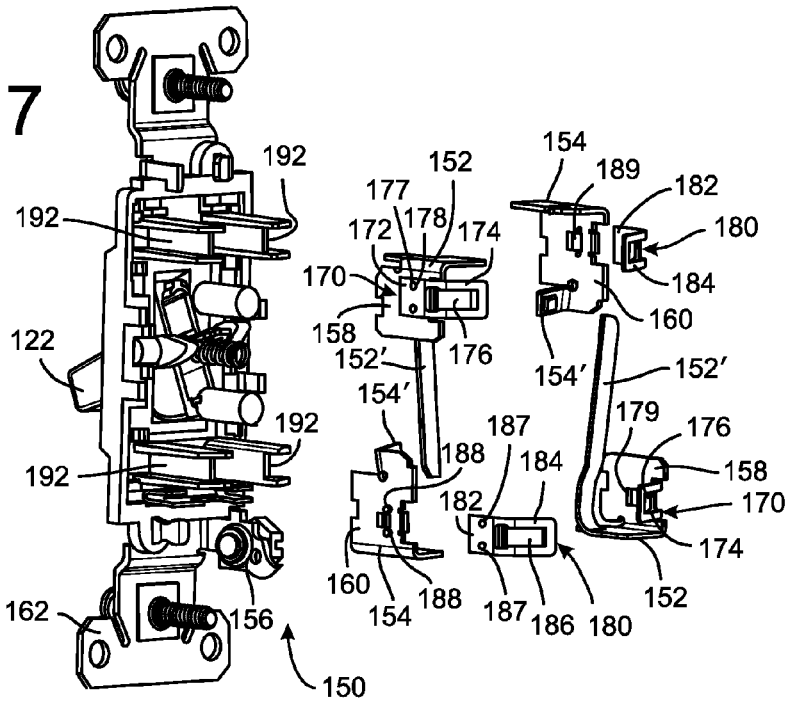
FIG. 17 is a rear perspective partially exploded view of the example electrical apparatus of FIG. 15.
Figure 18:
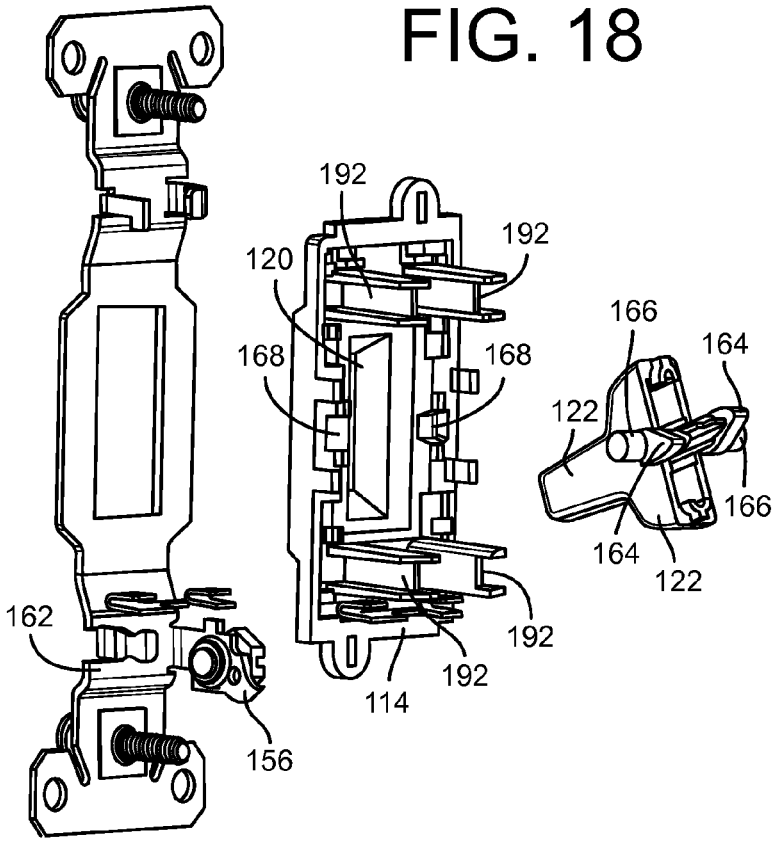
FIG. 18 is a rear perspective partially exploded view of the example of FIG. 15 but including only the ground strap, the front body of the housing and the non-conductive switch member.
Figure 19:
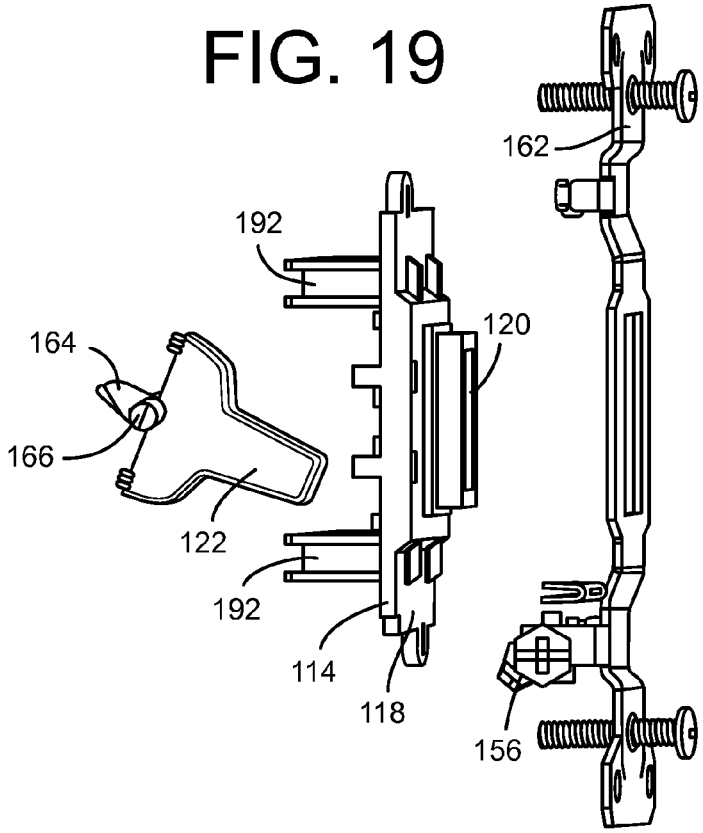
FIG. 19 is front perspective partially exploded view the example of FIG. 18.

In this example, as may be seen in FIG. 15, a further conductive stripped end 196 of a third wire engages the ground terminal 156. As shown, another conductive stripped end 198 of a wire may be inserted directly between a further spring finger 186 and a conductive contact 160, in a similar manner to the conductive stripped end 194 of the second wire.

The fixed connection between the first conductive contacts 152 and the first spring assemblies 170, and between the second conductive contact 154 and the second spring assemblies 180, permit more simple housing configurations and the electrical components to be more easily placed and located within the receptacle assembly 110 because such components need not be separately held by the housing in positions that must resist a separation force that is introduced when a wire end is inserted. Instead, the separation or displacement forces imposed when a conductive stripped end of a wire is inserted are controlled within the terminal structure 150 itself, without exerting forces on the housing 112.

FIGS. 20-29 illustrate another example electrical apparatus that employs novel terminal structures for wiring devices. The example electrical apparatus is shown in the form of a receptacle assembly 210 and more particularly here as a second switch, for commercial or residential use as may be electrically connected together with other components to form a wiring system for an interior or exterior of an enclosure, such as a room or building. As with the prior electrical apparatus, such receptacle assemblies may be mounted as needed, for instance within walls, floors and/or ceilings to provide a suitable wiring system. It will be understood that the example receptacle assembly 210 is an example of an electrical apparatus that is embodied in a 3-way switch, within which the novel terminal structures for wiring devices may be used, but is not an exclusive application or way in which such terminal structures may be employed.

Figure 20:
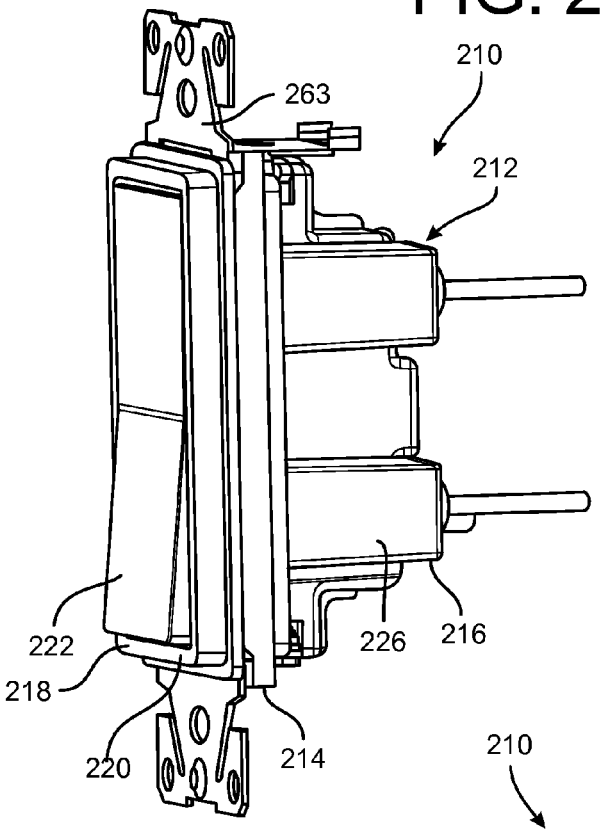
FIG. 20 is a front perspective view of a further example electrical apparatus employing the novel terminal structures for wiring devices of the present disclosure, in a second switch.
Figure 21:
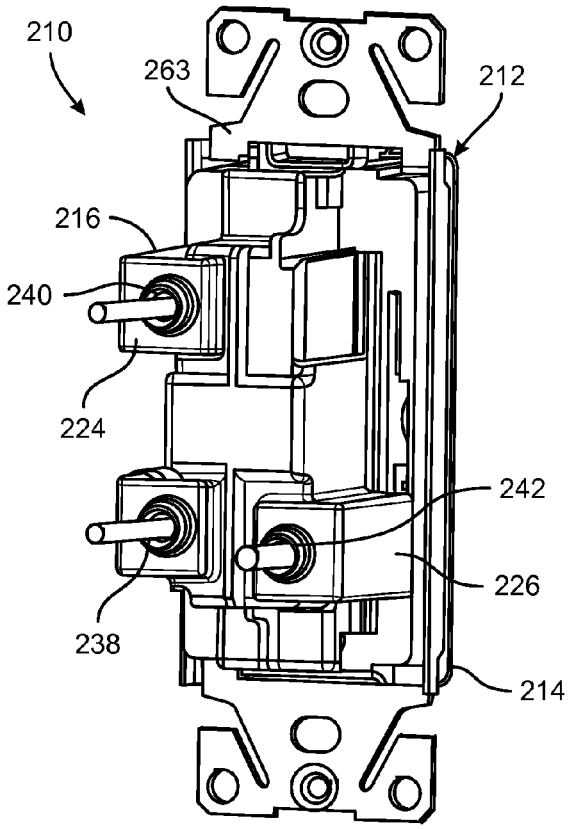
FIG. 21 is rear perspective view of the example electrical apparatus of FIG. 20.
Figure 22:
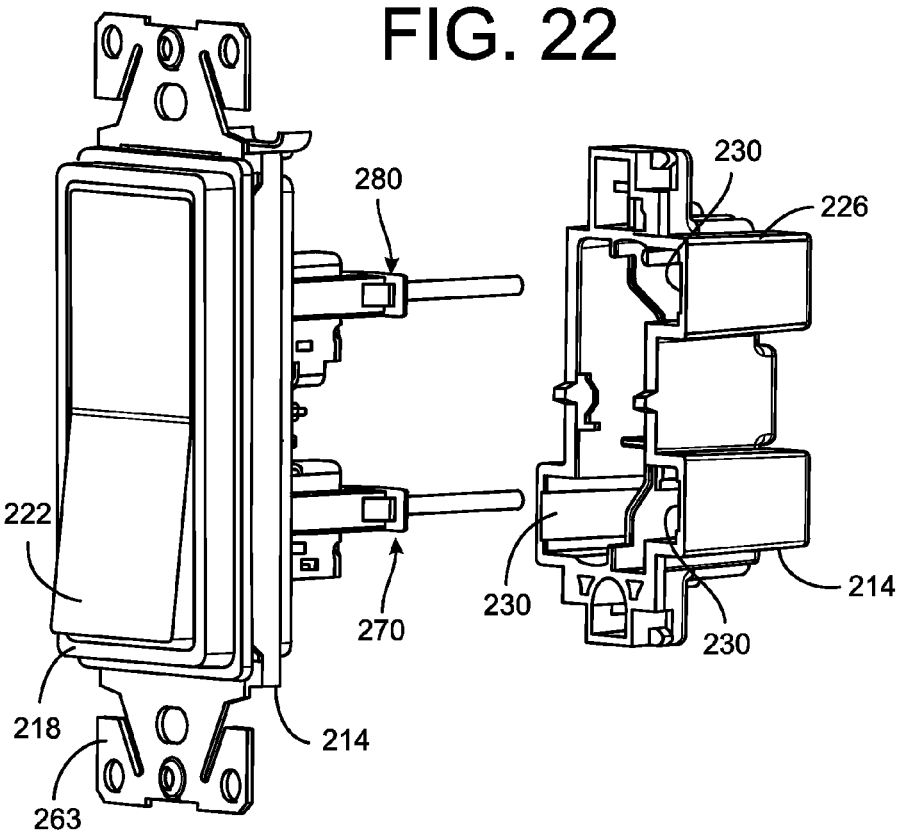
FIG. 22 is a front perspective partially exploded view of the example electrical apparatus of FIG. 20, having the rear body of the housing removed.
Figure 23:
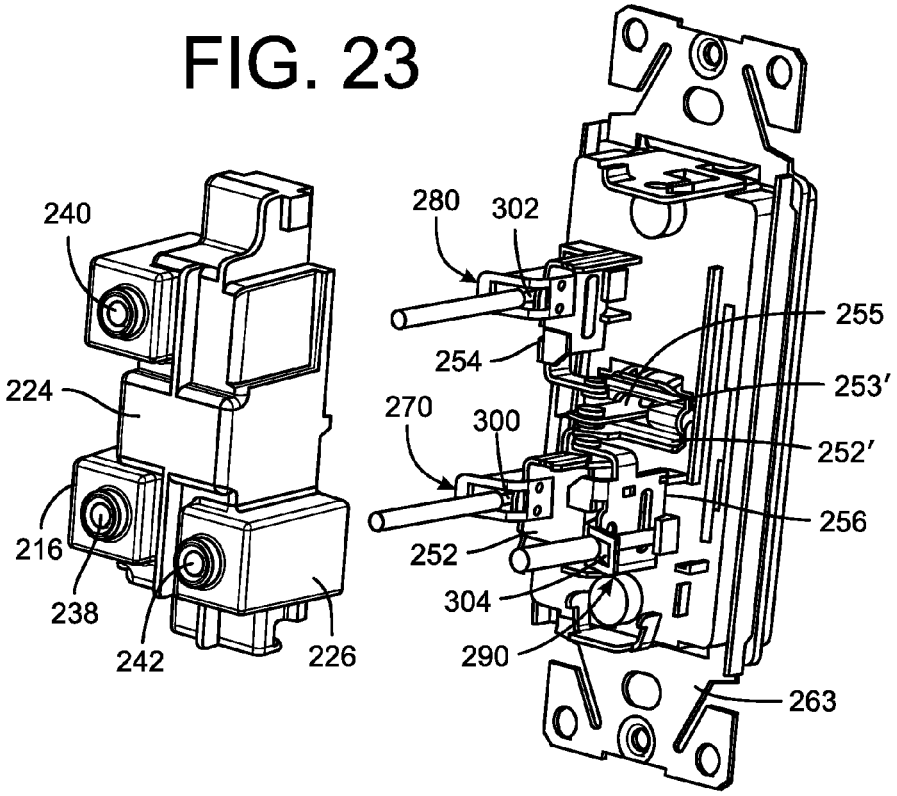
FIG. 23 is a rear perspective partially exploded view of the example electrical apparatus of FIG. 20, having the rear body of the housing removed and for ease of viewing, having the conductive switch member shown between On and Off positions.
Figure 24:
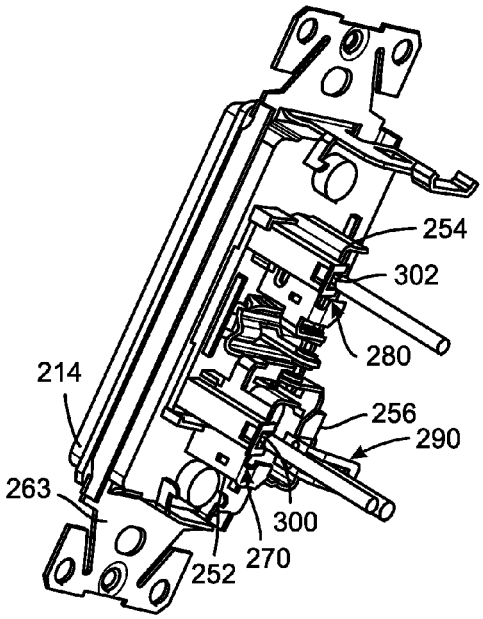
FIG. 24 is rear perspective view of the example electrical apparatus of FIG. 20, having wires inserted and without the rear body of the housing, and for ease of viewing, having the conductive switch member shown between the On and Off positions.
Figure 25:
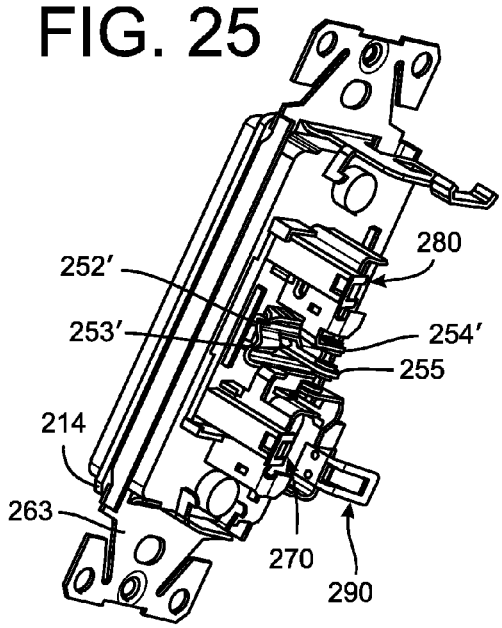
FIG. 25 is a rear perspective view of the example electrical apparatus of FIG. 24 but without wires.
Figure 26:
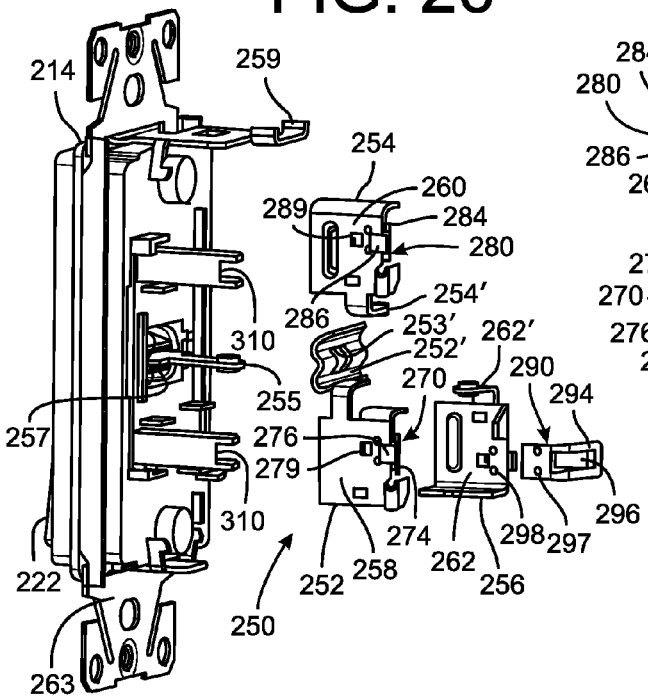
FIG. 26 is a rear perspective partially exploded view of the example electrical apparatus of FIG. 25.
Figure 27:
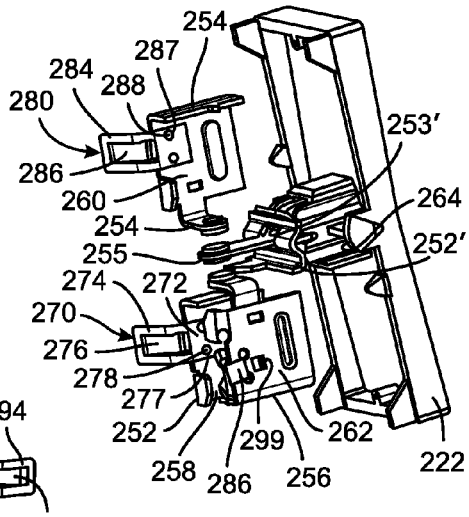
FIG. 27 is a rear perspective partially exploded view of the example of FIG. 26 but without the ground strap and the front body of the housing.
Figure 28:
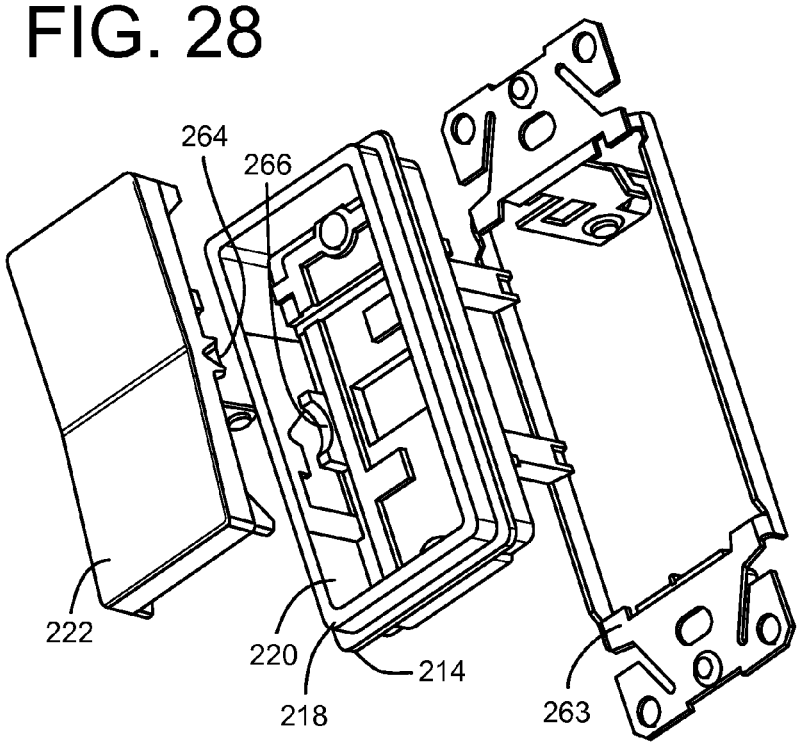
FIG. 28 is front perspective partially exploded view the example of FIG. 26 but including only the ground strap, the front body of the housing, the non-conductive switch member, and the conductive switch member.
Figure 29:
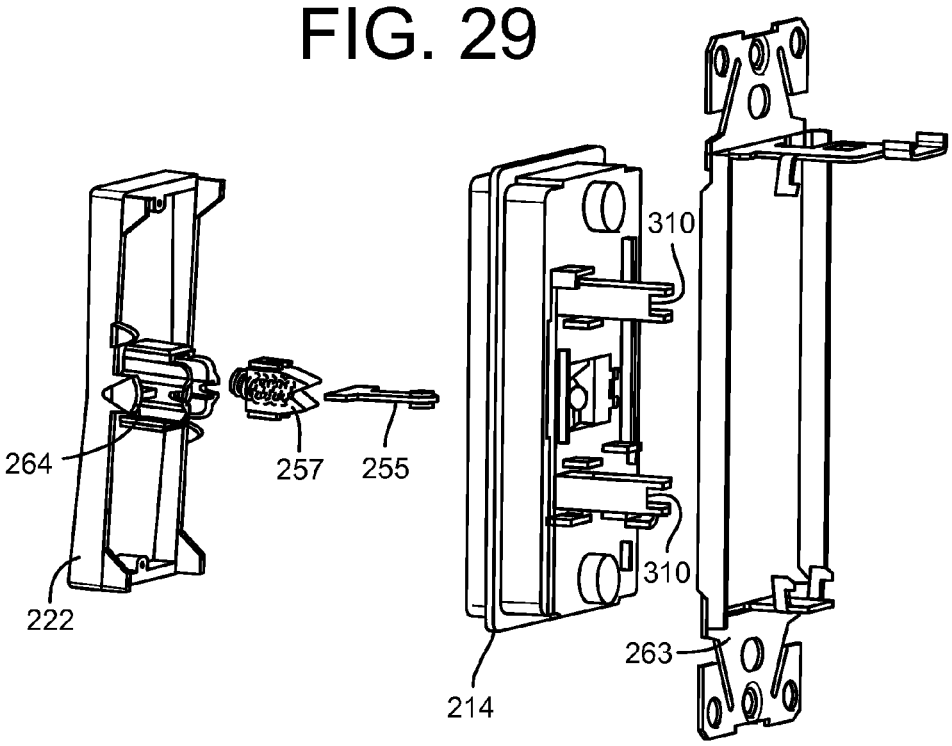
FIG. 29 is rear perspective partially exploded view the example of FIG. 27 but further having the non-conductive switch member spaced from the conductive switch member.

FIGS. 20 and 21 show the exterior of the receptacle assembly 210, which includes a housing 212 having a front body 214 and a rear body 216, with both components preferably being constructed of one or more non-conductive materials, such as thermoplastic, thermoset plastic or other suitable materials. It will be understood that, as with the prior examples, front and rear are used in a relative sense but the orientation of the final receptacle assembly alternatively could result in such housing portions being sides or top or bottom portions. The front body 214 includes a front face 218 having an opening therein 220 through which extends a non-conductive switch member 222 which may be manually operated to be moved between at least two operative positions, such as an Off position and an On position. The Off and On positions are respectively associated with disconnected and connected conditions as will be discussed further herein.

Turning to FIGS. 20-23, the rear body 216 includes a rear face 224 and an upstanding side wall 226 around the perimeter and projecting from the rear face 224. The interior surface of the rear face 224 includes receptacles 230 that receive the electrical connection assemblies. As may be seen in FIGS. 21 and 23, the rear face 224 of the rear body 216 of the housing 212 includes a first wire entry port 238, a second wire entry port 240 and a third wire entry port 242, with this example being illustrated as having one of each. The first wire entry port 238 may, for instance, receive a Hot wire, while the second wire entry port 240 may, for instance, receive a Traveler wire, and while the third wire entry port 242 may, for instance, receive a second Traveler wire. The front body 214 and rear body 216 of the housing 212 may be connected, such as by use of latching members, or by welding, adhesives, fasteners or other suitable means of connection.

In this example, the electrical apparatus in the form of the receptacle assembly 210 includes a terminal structure 250 for wiring devices, best seen in FIGS. 23-27, which for ease of viewing, have a conductive switch member shown between On and Off positions. The terminal structure 250 of this example includes a first conductive contact 252, a second conductive contact 254 and a third conductive contact 256. The first, second and third conductive contacts 252, 254 and 256 each include a body portion 258, 260, 262 respectively, and are constructed of one or more highly conductive materials, such as brass or another copper alloy, or other suitable conductive materials. A conductive contact 259 is a ground terminal connected to a ground strap 263, and the ground strap 263 may be constructed of the same material as the first, second and third conductive contacts, but more likely will be constructed of a more rigid yet still conductive material, such as galvanized steel, or one or more other suitable conductive materials.

Each first conductive contact 252 is configured to include an extension 252' from the body portion 258, with the extension 252' including an opening 253'. The second conductive contact 254 includes an extension 254' that extends from the respective body portion 260 of the second conductive contacts 254. Engagement between the respective extensions 252' and 254' is controlled by movement of the non-conductive switch member 222 which receive a conductive switch member 255 that extends rearward from a conductive switch member holder 257 that is connected to the non-conductive switch member 222. The conductive switch member 255 also extends through the opening 253' in the extension from the first conductive contact 252. The rear of the non-conductive switch member 222 further includes pivots 264 that pivotally engage receptacles 266 on the interior of the front body 214. Operation of the switch depends on the position of the non-conductive switch member 222. When the non-conductive switch member 222 is moved to the Off position, the conductive switch member 255 that extends through the opening 253' is spaced from the side walls of the opening 253' in the extension 252' from the first contact 252 and is spaced from the extension 254' of the second contact 254, thereby disconnecting the respective conductive contacts 252 and 254, and further more connecting switch member 255 to an extension 262' of the third conductive contact 262. When the non-conductive switch member 222 is moved to the On position, the conductive switch member 255 is moved to a position where it engages a side wall in the opening 253' in the extension 252' of the first conductive contact 252 and engages and is electrically connected to the extension 254' on the second conductive contact 254.

The example terminal structure 250 in the electrical apparatus 210 includes spring assemblies to facilitate push-in termination of conductive stripped ends of respective wires. As with the prior example, the spring assemblies preferably may be constructed of one or more materials that are more suitable for use as a spring, such as stainless steel, phosphor bronze, steel or other suitable materials to resist stress-relaxation and yielding over time, while still having some conductivity. Each spring assembly includes at least one spring finger coupled to a foot portion. For instance, a first spring assembly 270 includes a foot portion 272, an upstanding leg 274 and at least one spring finger 276 extending from the upstanding leg 274. Once again, it will be understood that the term "foot portion" is not used herein to denote a relative position, such as being above or below or in any other direction relative to another structure, and in that sense could also be considered simply to denote a base. It also will be understood that the at least one spring finger is coupled to the foot portion in this example via an upstanding leg 274, but the term "upstanding leg" is not used herein to denote a relative position or direction, but rather could refer to a structure that extends upward, downward or in any other direction relative to the foot portion.

In this example, the spring assembly 270 is fixed to a body portion 258 of the respective first conductive contact 252. To achieve this, each foot portion 272 includes at least one aperture 277 that receives a post 278 that extends from the body portion 158, and each post 278 then is deformed to connect the first spring assembly 270 to the first conductive contact 252. It will be appreciated that other means of connecting a spring assembly to a conductive contact may be used, such as by welding, use of a separate fastener or other suitable connection means. Each body portion 258 has a surface opposite a spring finger 276 that includes an optional projection 279 configured to contact a respective conductive stripped end of a wire.

Similarly, a second spring assembly 280 includes a foot portion 282, an upstanding leg 284 and at least one spring finger 286 extending from the upstanding leg 284. Again, the term "foot portion" is not used herein to denote a relative position, and the at least one spring finger is coupled to the foot portion via an upstanding leg 284, with the term "upstanding leg" also not used herein to denote a relative position or direction.

The second spring assembly 280 is fixed to a body portion 260 of a respective second conductive contact 254. To achieve this, each foot portion 282 includes at least one aperture 287 that receives a post 288 that extends from the body portion 260, and each post 288 then is deformed to connect the second spring assembly 280 to the second conductive contact 254. As discussed above, it will be appreciated that other means of connecting a spring assembly to a conductive contact may be used. Each body portion 260 has a surface opposite the spring finger 286 that in this example includes an optional projection 289 configured to contact a respective conductive stripped end of a wire.

A third spring assembly 290 includes a foot portion 292, an upstanding leg 294 and at least one spring finger 296 extending from the upstanding leg 294. "Foot portion" is not used herein to denote a relative position, and the at least one spring finger is coupled to the foot portion via an upstanding leg 294, with the term "upstanding leg" also not used herein to denote a relative position or direction.

The third spring assembly 290 is fixed to a body portion 262 of a respective third conductive contact 256. To achieve this, each foot portion 292 includes at least one aperture 297 that receives a post 298 that extends from the body portion 262, and each post 298 then is deformed to connect the third spring assembly 290 to the third conductive contact 256. As discussed above, it will be appreciated that other means of connecting a spring assembly to a conductive contact may be used. Each body portion 262 has a surface opposite the spring finger 296 that in this example includes an optional projection 299 configured to contact a respective conductive stripped end of a wire.

The first wire entry port 238 in the rear face 224 of the rear body 216 is configured to receive and direct an inserted wire. A conductive stripped end 300 of a first wire, such as a Hot wire, may be inserted through the first wire entry port 238 which will guide the conductive stripped end 300 of the first wire into engagement with the at least one spring finger 276. As the wire end 300 is further advanced, the spring finger 276 that is coupled to a foot portion 274 and thereby fixed to a first contact 252 will bend and permit the wire end to pass through the spring assembly 270 where the wire end will engage the first conductive contact 252. While an adequate electrical connection may be achieved when a stripped wire end engages a flat conductive contact, in this example, as the wire end engages the first conductive contact 252 it will ride up and over the optional projection 279 which will assist in establishing a firm connection between the conductive stripped end 300 of the first wire and the first conductive contact 252, whether solid or stranded wire, also increasing the resistance to wire pull-out.

The high level of conductivity of the first conductive contact 252 promotes a good electrical connection, and this is further aided by the spring assembly 270 having some conductivity and being connected to the first conductive contact 252. In addition, the first spring assembly 270, being constructed of a material more fitting for usage as a spring, provides enhanced clamping performance initially and is less likely to relax or yield over repeated use or time. The conductive stripped end of the wire need not be bent by a user during installation so as to encircle a screw, and as the straight wire end is advanced it will come to rest in one of the channels 310 that project from the rear of the front body 214, where the conductive stripped end of the wire will be contained and shielded from inadvertent contact with other components. It will be appreciated that such channels provide an example of promoting an advantageous but not necessarily required means of achieving and maintaining wire separation. Such channels also may assist in keeping stranded wires from splaying, thus promoting more consistent conductive contact engagement.

In a similar manner, the second wire entry port 240 in the rear face 224 of the rear body 216 is configured to receive and direct a second respective inserted wire. A conductive stripped end 302 of a second wire, such as a Traveler wire, may be inserted through the second wire entry port 240 which will guide the conductive stripped end 302 into engagement with the at least one spring finger 286. As the conductive stripped end 302 of the second wire is further advanced, the spring finger 286 that is coupled to a foot portion 284 and thereby fixed to a second contact 254 will bend and permit the wire end to pass through the spring assembly 280 where the wire end will engage the second conductive contact 254. While an adequate electrical connection may be achieved when a stripped wire end engages a flat conductive contact, in this example, as the wire end engages the second conductive contact 254 it will ride up and over the optional projection 289 which will assist in establishing a firm connection between the conductive stripped end 302 of the second wire and the second conductive contact 254, whether solid or stranded wire, also increasing the resistance to wire pull-out.

The high level of conductivity of the second conductive contact 254 promotes a good electrical connection, and this is further aided by the spring assembly 280 having some conductivity and being connected to the second conductive contact 254. In addition, the second spring assembly 280, being constructed of a material more fitting for usage as a spring, provides enhanced clamping performance initially and is less likely to relax or yield over repeated use or time. As with the conductive stripped end of the first wire, the conductive stripped end of the second wire need not be bent by a user during installation so as to encircle a screw, and as the straight wire end is advanced it will come to rest in one of the channels 310 that project from the rear of the front body 214, where the conductive stripped end of the wire will be contained and shielded from inadvertent contact with other components. It will be appreciated that such channels provide an example of promoting an advantageous but not necessarily required means of achieving and maintaining wire separation. Such channels also may assist in keeping stranded wires from splaying, thus promoting more consistent conductive contact engagement.

In a similar manner, the third wire entry port 242 in the rear face 224 of the rear body 216 is configured to receive and direct a third respective inserted wire. A conductive stripped end 304 of a third wire, such as a second Traveler wire, may be inserted through the third wire entry port 242 which will guide the conductive stripped end 304 into engagement with the at least one spring finger 296. As the conductive stripped end 304 of the third wire is further advanced, the spring finger 296 that is coupled to a foot portion 294 and thereby fixed to a third contact 256 will bend and permit the wire end to pass through the spring assembly 290 where the wire end will engage the third conductive contact 256. While an adequate electrical connection may be achieved when a stripped wire end engages a flat conductive contact, in this example, as the wire end engages the third conductive contact 256 it will ride up and over the optional projection 299 which will assist in establishing a firm connection between the conductive stripped end 304 of the third wire and the third conductive contact 256, whether solid or stranded wire, also increasing the resistance to wire pull-out.

The high level of conductivity of the third conductive contact 256 promotes a good electrical connection, and this is further aided by the spring assembly 290 having some conductivity and being connected to the third conductive contact 256. In addition, the third spring assembly 290, being constructed of a material more fitting for usage as a spring, provides enhanced clamping performance initially and is less likely to relax or yield over repeated use or time. As with the conductive stripped end of the first wire, the conductive stripped end of the third wire need not be bent by a user during installation so as to encircle a screw.

The fixed connection between the first conductive contact 252 and the first spring assembly 270, between the second conductive contact 254 and the second spring assembly 280, and between the third conductive contact 256 and the third spring assembly 290 permit more simple housing configurations and the electrical components to be more easily placed and located within the receptacle assembly 210 because such components need not be separately held by the housing in positions that must resist a separation force that is introduced when a wire end is inserted. Instead, the separation or displacement forces imposed when a conductive stripped end of a wire is inserted are controlled within the terminal structure 250 itself, without exerting forces on the housing 212.

Using the terminal structures and electrical apparatus described herein, whether within an electrical device that acts as a receptacle assembly in the form of a duplex outlet, a grounding duplex outlet, a switch, a light socket or otherwise, it will be appreciated that a plurality of electrical apparatus may be combined into a system in many denominations and configurations, as desired. Further, this disclosure is not intended to be limiting with respect to the particular choice of materials, dimensions or other aspects of the structures and components referred to herein. Accordingly, it is intended that the appended claims be interpreted as covering all alterations and modifications that fall within the scope of the appended claims and that the claims are not limited to the example illustrated.

I claim:

1. A terminal structure for wiring devices for use within a housing of an electrical apparatus, the terminal structure comprising:

a first spring assembly constructed of a first metal and having at least one spring finger with the first spring assembly being fixedly connected to a first conductive contact that is constructed of a second metal, wherein the terminal structure is configured to receive a conductive stripped end of a first wire when the conductive stripped end of the first wire is inserted directly between the at least one spring finger of the first spring assembly and the first conductive contact, wherein the first conductive contact includes an extension;

a second spring assembly constructed of the first metal and having at least one spring finger with the second spring assembly being fixedly connected to a second conductive contact that is constructed of the second metal, wherein the terminal structure is configured to receive a conductive stripped end of a second wire when the conductive stripped end of the second wire is inserted directly between the at least one spring finger of the second spring assembly and the second conductive contact, and wherein the second conductive contact includes an extension; and wherein the extension of the first conductive contact is configured to be electrically connected to the extension of the second conductive contact when a movable non-conductive switch member is in an On position and to be electrically disconnected from the extension of the second conductive contact when the non-conductive switch member is in an Off position.

2. The terminal structure for wiring devices of claim 1, wherein each conductive contact further comprises a body portion having a surface opposite the respective spring finger that includes a projection configured to contact a respective conductive stripped end of a wire.

3. The terminal structure for wiring devices of claim 1, further comprising a third spring assembly constructed of the first metal and having at least one spring finger with the third spring assembly being fixedly connected to a third conductive contact that is constructed of the second metal, wherein the terminal structure is configured to receive a conductive stripped end of a third wire when the conductive stripped end of the third wire is inserted directly between the at least one spring finger of the third spring assembly and the third conductive contact.

4. The terminal structure for wiring devices of claim 1, further comprising a Ground terminal adapted for connection to a Ground wire.

5. The terminal structure for wiring devices of claim 1, wherein the non-conductive switch member is connected to a conductive switch member.

6. The terminal structure for wiring devices of claim 1, wherein the non-conductive switch member is configured to have the extension of the first conductive contact engage the extension of the second conductive contact when the non-conductive switch member is in the On position.

7. The terminal structure for wiring devices of claim 1, wherein each of the first and second spring assemblies further comprises a foot portion connected to the respective conductive contact and the at least one spring finger is coupled to the foot portion.

8. The terminal structure for wiring devices of claim 7, wherein each of the first and second spring assemblies further comprises an upstanding leg extending from the foot portion and the at least one spring finger extends from the upstanding leg.

9. The terminal structure for wiring devices of claim 5, wherein the extension of the first conductive contact further comprises an opening through which extends the conductive switch member.

10. The terminal structure for wiring devices of claim 9, wherein the conductive switch member is configured to engage the extension of the first conductive contact and the extension of the second conductive contact when the non-conductive switch member is in the On position.

11. The terminal structure for wiring devices of claim 9, wherein the conductive switch member is configured to be spaced from the extension of the second conductive contact when the non-conductive switch member is in the Off position.

12. The terminal structure for wiring devices of claim 1, wherein the non-conductive switch member is configured to space the extension of the first conductive contact from the extension of the second conductive contact when the non-conductive switch member is in the Off position.

13. The terminal structure for wiring devices of claim 11, wherein the non-conductive switch member further comprises a projection that causes deflection of the extension of the first conductive contact when the non-conductive switch member is in the Off position.

14. A receptacle assembly comprising a housing and a terminal structure, the terminal structure disposed in the housing and comprising:

a first spring assembly constructed of a first metal and having at least one spring finger with the first spring assembly being fixedly connected to a first conductive contact that is constructed of a second metal, wherein the terminal structure is configured to receive a conductive stripped end of a first wire when the conductive stripped end of the first wire is inserted directly between the at least one spring finger of the first spring assembly and the first conductive contact, wherein the first conductive contact includes an extension;

a second spring assembly constructed of the first metal and having at least one spring finger with the second spring assembly being fixedly connected to a second conductive contact that is constructed of the second metal, wherein the terminal structure is configured to receive a conductive stripped end of a second wire when the conductive stripped end of the second wire is inserted directly between the at least one spring finger of the second spring assembly and the second conductive contact, and wherein the second conductive contact includes an extension; and wherein the extension of the first conductive contact is configured to be electrically connected to the extension of the second conductive contact when a movable non-conductive switch member is in an On position and to be electrically disconnected from the extension of the second conductive contact when the non-conductive switch member is in an Off position.

15. The receptacle assembly of claim 14, wherein the housing is constructed of one or more non-conductive materials.

16. The receptacle assembly of claim 14, wherein the housing further comprises at least first and second wire entry ports, with the first wire entry port being adapted to receive and direct a conductive stripped end of a first wire into engagement between the spring finger of the first spring assembly and the first conductive contact, and the second wire port being adapted to receive and direct a conductive stripped end of a second wire into engagement between the a spring finger of the second spring assembly and the second conductive contact.

17. The receptacle assembly of claim 14, wherein the housing includes a pair of bodies.

18. The receptacle assembly of claim 17, wherein at least one of the pair of bodies further comprises a front body having an opening through which the non-conductive switch member extends.

19. The receptacle assembly of claim 17, wherein at least one of the pair of bodies further comprises a rear body having a plurality of wire entry ports.

* * * * *